US011333461B2

(12) United States Patent
Cauley, Jr. et al.

(10) Patent No.: US 11,333,461 B2
(45) **Date of Patent: *May 17, 2022**

(54) RECOIL-REDUCING FIREARM SHOOTING REST HAVING TANK

(71) Applicant: AOB Products Company, Columbia, MO (US)

(72) Inventors: Dennis W. Cauley, Jr., Fayette, MO (US); James Tayon, Moberly, MO (US); Timothy S. Kinney, Warrenton, MO (US); Michael Cottrell, Ashland, MO (US); Justin Burke, Columbia, MO (US); Brian Steere, Columbia, MO (US); Mark Dalton, Columbia, MO (US); Kyle Martin, Columbia, MO (US); Anthony Vesich, Columbia, MO (US); Matthew Kinamore, Columbia, MO (US); Curtis Smith, Columbia, MO (US); Joel Yuodsnukis, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/027,673

(22) Filed: Sep. 21, 2020

(65) Prior Publication Data

US 2021/0041202 A1 Feb. 11, 2021

Related U.S. Application Data

(63) Continuation of application No. 16/276,766, filed on Feb. 15, 2019, now Pat. No. 10,782,085.

(51) Int. Cl.
*F41A 23/16* (2006.01)
*F41A 23/12* (2006.01)

(52) U.S. Cl.
CPC ..... *F41A 23/16* (2013.01); *F41A 23/12* (2013.01)

(58) Field of Classification Search
CPC ..... F41A 23/16; F41A 23/12; F41A 23/02; F41A 23/18

(Continued)

(56) References Cited

U.S. PATENT DOCUMENTS 197,397 A 11/1877 O'Neil
387,411 A 8/1888 Gisel (Continued)

FOREIGN PATENT DOCUMENTS

| | | |
|---|---|---|
| DE | 838872 | 5/1952 |
| EP | 0624455 | 11/1994 |
| GB | 475080 | 11/1937 |

OTHER PUBLICATIONS

Non-Final Office Action dated Feb. 6, 2020 relating to U.S. Appl. No. 16/276,766, 84 pages.

(Continued)

*Primary Examiner* — Joshua E Freeman
(74) *Attorney, Agent, or Firm* — Stinson LLP

(57) ABSTRACT

A shooting rest, components thereof, and associated methods. The shooting rest includes a frame, a forward firearm support connected to the frame, and a rear firearm support connected to the frame. The rear firearm support includes a stop configured to limit rearward movement of the firearm with respect to the frame when the firearm is fired. A liquid tank is supported by the frame and is configured to hold liquid to increase the effective mass of the shooting rest to reduce recoil felt by a shooter when the firearm is fired.

15 Claims, 14 Drawing Sheets

(58) Field of Classification Search
USPC ..... 42/94
See application file for complete search history.

(56) References Cited

U.S. PATENT DOCUMENTS

| | | | |
|---|---|---|---|
| 399,604 | A | 3/1889 | Dufner et al. |
| 407,418 | A | 7/1889 | Schneider |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,499,748 | A | 5/1922 | Papouchis |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,427,365 | A | 3/1944 | Meister |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthornet et al. |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,874,707 | A | 2/1959 | Koppel |
| 2,877,689 | A | 3/1959 | Pribis |
| 2,894,347 | A | 7/1959 | Woodcock |
| 3,064,976 | A | 11/1959 | Kuhn |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,013,289 | A | 12/1961 | Sasena |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,358,504 | A | 12/1967 | Freebairn |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,473,673 | A | 10/1969 | Porter |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |

(56) References Cited

U.S. PATENT DOCUMENTS 3,771,176 A * 11/1973 Herman, Sr. ..... A61G 7/1003 4/578.1
3,804,238 A 4/1974 Howard
3,813,816 A 6/1974 Funk
3,815,270 A 6/1974 Pachmayr
3,826,559 A 7/1974 Berliner et al.
3,827,172 A 8/1974 Howe
3,842,527 A 10/1974 Low
D233,853 S 12/1974 Ferrara
3,876,078 A 4/1975 Gomes et al.
3,877,178 A 4/1975 Campanelli
3,878,939 A 4/1975 Wilcox
3,885,357 A 5/1975 Hoyt
3,893,266 A 7/1975 Anderson et al.
3,895,803 A 7/1975 Loe
3,899,175 A 8/1975 Loe
3,899,797 A 8/1975 Gunst
D237,106 S 10/1975 Baljet et al.
3,913,746 A 10/1975 Burton
3,914,879 A 10/1975 Taylor, III et al.
3,935,657 A 2/1976 Wade
3,947,988 A 4/1976 Besaw
3,949,987 A 4/1976 Candor
3,961,436 A 6/1976 Hagen et al.
3,964,613 A 6/1976 Anderson, Jr.
3,979,849 A 9/1976 Haskins
4,007,554 A 2/1977 Helmstadter
4,012,860 A 3/1977 Auger
4,018,339 A 4/1977 Pritz
4,021,971 A 5/1977 McFadden
4,026,057 A 5/1977 Cady
4,027,781 A 6/1977 Covert
4,042,242 A 8/1977 Nicholls et al.
4,054,288 A 10/1977 Perrine, Sr.
4,055,016 A 10/1977 Katsenes
4,072,313 A 2/1978 Murso et al.
4,076,247 A 2/1978 Kim et al.
4,090,606 A 5/1978 Dawson
4,120,108 A 10/1978 Vickers et al.
4,120,276 A 10/1978 Curran
4,122,623 A 10/1978 Stice
4,143,491 A 3/1979 Blanc
4,177,608 A 12/1979 Balz
4,188,855 A 2/1980 Alberts
4,203,600 A 5/1980 Brown
4,206,573 A 6/1980 Hayward
4,207,699 A 6/1980 Hensley
4,222,305 A 9/1980 Lee
4,223,588 A 9/1980 Simpson
4,233,748 A 11/1980 Ford et al.
D257,687 S 12/1980 Bechtel
4,265,045 A 5/1981 Garbini
4,266,748 A 5/1981 Dalton
4,266,780 A 5/1981 McQuary
4,282,671 A 8/1981 Wood et al.
D260,650 S 9/1981 Alviti
D261,794 S 11/1981 Bechtel
4,301,625 A 11/1981 Rampe
4,312,146 A 1/1982 Koon, Jr. et al.
4,332,185 A 6/1982 Hargrove
4,333,385 A 6/1982 Culver
4,338,726 A 7/1982 Swailes
4,340,370 A 7/1982 Marshall et al.
4,345,398 A 8/1982 Pickett
4,346,530 A 8/1982 Stewart et al.
4,359,833 A 11/1982 Pachmayr et al.
4,361,989 A 12/1982 Ohno
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,409,826 A 10/1983 Wenger
4,426,085 A 1/1984 Dixon
4,438,913 A 3/1984 Hylla
4,446,900 A 5/1984 Markovich
4,449,314 A 5/1984 Sorensen
4,462,598 A 7/1984 Chalin et al.
4,477,082 A 10/1984 McKenzie et al.
4,480,411 A 11/1984 Blaz et al.
4,501,071 A 2/1985 Manske
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,540,182 A 9/1985 Clement
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Homer
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 Shaine
4,715,476 A 12/1987 France
4,715,499 A 12/1987 Franklin
4,716,673 A 1/1988 Williams et al.
4,721,205 A 1/1988 Burt et al.
4,723,472 A 2/1988 Lee
4,729,186 A 3/1988 Rieger
4,732,394 A 3/1988 Stein et al.
4,736,843 A 4/1988 Leonard
4,739,996 A 4/1988 Vedder
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,807,888 A 2/1989 Pidde et al.
4,815,593 A 3/1989 Brown
4,819,359 A 4/1989 Bassett
4,821,256 A 4/1989 Schmidt et al.
4,821,422 A 4/1989 Porter
4,821,443 A 4/1989 Bianco et al.
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,877,131 A 10/1989 Patros et al.
4,890,406 A 1/1990 French
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,923,402 A 5/1990 Marshall et al.
4,924,616 A 5/1990 Bell
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A 11/1990 Eckert
4,979,752 A 12/1990 Fosseen
D313,886 S 1/1991 Southard
4,987,694 A 1/1991 Lombardo
4,998,367 A 3/1991 Leibowitz

(56) References Cited

U.S. PATENT DOCUMENTS 4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,143,340 A 9/1992 Wood et al.
5,149,900 A 9/1992 Buck
5,173,563 A 12/1992 Gray
5,180,874 A 1/1993 Troncoso, Jr
5,185,927 A 2/1993 Rivers
5,186,468 A 2/1993 Davies
5,188,371 A 2/1993 Edwards
5,194,678 A 3/1993 Kramer
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,232,227 A 8/1993 Bateman
5,233,779 A * 8/1993 Shaw ..... F41A 23/02 42/94
5,235,764 A 8/1993 Perazzi
5,237,778 A 8/1993 Baer
5,240,258 A 8/1993 Bateman
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,320,217 A 6/1994 Lenarz
5,320,223 A 6/1994 Allen
5,328,029 A 7/1994 Chow et al.
5,332,185 A 7/1994 Walker, III
5,333,404 A 8/1994 Lingyak
5,333,829 A 8/1994 Bell et al.
5,335,578 A 8/1994 Lorden et al.
5,337,505 A 8/1994 Brown et al.
5,344,012 A 9/1994 Matthews
5,347,740 A 9/1994 Rather et al.
5,351,428 A 10/1994 Graham
5,354,247 A 10/1994 Wilkinson
5,358,254 A 10/1994 Yeh et al.
5,361,505 A 11/1994 Faughn
5,367,232 A 11/1994 Netherton et al.
5,370,240 A 12/1994 Hand
5,375,377 A 12/1994 Kenton
5,392,553 A 2/1995 Carey
5,394,983 A 3/1995 Latulippe et al.
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,433,451 A 7/1995 DeVries
5,435,223 A 7/1995 Blodgett et al.
5,442,860 A 8/1995 Palmer
D362,116 S 9/1995 Bellington et al.
5,446,987 A 9/1995 Lee et al.
D364,080 S 11/1995 Weyrauch
5,481,817 A 1/1996 Parker
5,482,241 A 1/1996 Oglesby
5,486,135 A 1/1996 Arpaio
5,490,302 A 2/1996 Dion
5,491,921 A 2/1996 Allen
5,497,557 A 3/1996 Martinsson et al.
5,497,575 A 3/1996 Fried et al.
D369,904 S 5/1996 Taylor
5,501,467 A 6/1996 Kandel
5,525,314 A 6/1996 Hurson
5,540,329 A 7/1996 Vogeley
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,588,242 A 12/1996 Hughes
5,600,913 A 2/1997 Minneman
5,617,666 A 4/1997 Scott
5,622,344 A 4/1997 Gracie
5,628,135 A 5/1997 Cady
D380,116 S 6/1997 Minneman
5,640,944 A 6/1997 Minneman
5,644,862 A 7/1997 Folmer
5,649,465 A 7/1997 Beebe
5,651,207 A 7/1997 Knight
5,653,625 A 8/1997 Pierce et al.
5,661,919 A 9/1997 Pryor
5,662,516 A 9/1997 You
5,666,757 A 9/1997 Helmstadter
D387,123 S 12/1997 Hughes et al.
5,703,317 A 12/1997 Levilly et al.
5,704,482 A 1/1998 Apps et al.
5,711,102 A 1/1998 Plaster et al.
5,711,103 A 1/1998 Keng
5,715,625 A 2/1998 West, III
D391,616 S 3/1998 Plybon
5,723,183 A 3/1998 Williams et al.
5,723,806 A 3/1998 Odom
5,725,096 A 3/1998 Winnard
5,737,865 A 4/1998 Brandi et al.
5,740,625 A 4/1998 Jenkins
5,743,395 A 4/1998 Backer
5,758,447 A 6/1998 Venetz
5,758,933 A 6/1998 Clendening
5,761,954 A 6/1998 Dvorak
5,778,589 A 7/1998 Teague
5,779,527 A 7/1998 Maebashi
5,791,499 A 8/1998 Zebbedies
5,811,720 A 9/1998 Quinnell et al.
5,815,974 A 10/1998 Keng
5,833,308 A 11/1998 Strong, III et al.
D403,176 S 12/1998 Harper
5,845,774 A 12/1998 Hausknecht
5,857,279 A 1/1999 de Oliveira Masina et al.
5,875,580 A 3/1999 Hill et al.
5,878,504 A 3/1999 Harms
5,884,966 A 3/1999 Hill et al.
5,899,329 A 5/1999 Hu et al.
5,907,919 A 6/1999 Keeney
5,913,131 A 6/1999 Hossain et al.
5,913,422 A 6/1999 Cote et al.
5,913,667 A 6/1999 Smilee
5,913,668 A 6/1999 Messer
5,924,694 A 7/1999 Kent
5,930,932 A 8/1999 Peterson
5,933,997 A 8/1999 Barrett
5,933,999 A 8/1999 McClure et al.
5,937,561 A 8/1999 Abernethy
5,959,613 A 9/1999 Rosenbreg et al.
5,970,642 A 10/1999 Martin
5,974,719 A 11/1999 Simonek
6,019,375 A 2/2000 West, Jr.
6,021,891 A 2/2000 Anderson
6,032,796 A 3/2000 Hopper et al.
6,042,080 A 3/2000 Shepherd et al.
6,044,747 A 4/2000 Felts
6,058,641 A 5/2000 Vecqueray
6,073,381 A 6/2000 Farrar et al.
6,086,375 A 7/2000 Legros

(56) References Cited

U.S. PATENT DOCUMENTS 6,092,662 A 7/2000 Frederick, Jr. et al.
6,110,020 A 8/2000 Rolfi
6,121,556 A 9/2000 Cole
6,237,462 B1 5/2001 Hawkes et al.
6,253,482 B1 * 7/2001 Peterson ..... F41A 23/02 42/94
6,254,100 B1 7/2001 Rinehart
6,260,463 B1 7/2001 Brand et al.
6,269,578 B1 8/2001 Callegari
6,283,428 B1 9/2001 Maples et al.
6,289,622 B1 9/2001 Desch, Jr. et al.
6,293,041 B2 9/2001 Weaver
6,294,759 B1 9/2001 Dunn, Jr.
6,305,117 B1 10/2001 Hales, Sr.
6,309,476 B1 10/2001 Ravenscroft et al.
6,338,218 B1 1/2002 Hegler
6,390,294 B1 5/2002 Fiore et al.
6,397,720 B1 6/2002 Fox et al.
6,439,515 B1 8/2002 Powers
6,439,530 B1 8/2002 Shoenfish et al.
6,517,133 B2 2/2003 Seegmiller et al.
D471,248 S 3/2003 Jacobs
6,526,687 B1 3/2003 Looney
D473,376 S 4/2003 Abate
6,546,662 B1 4/2003 Chong
6,557,855 B2 5/2003 Wu
6,574,899 B1 6/2003 Mostello
6,575,469 B2 6/2003 Lowe
6,643,973 B1 11/2003 Smith
6,663,298 B2 12/2003 Haney
6,688,031 B2 2/2004 Steele
6,733,375 B2 5/2004 Hoffman
6,736,400 B1 5/2004 Cesternino
6,813,855 B2 11/2004 Pinkley
6,814,654 B2 11/2004 Rolfi
6,854,975 B2 2/2005 Ranzinger
6,860,054 B1 3/2005 Mosher
6,860,055 B1 3/2005 Walrath
6,862,833 B1 3/2005 Gutner
6,871,440 B2 3/2005 Highfill et al.
6,877,266 B1 4/2005 Brownlee
6,883,263 B1 4/2005 Carrow
6,931,777 B1 8/2005 Krien
6,953,114 B2 10/2005 Wang et al.
D513,055 S 12/2005 Lahti
6,978,569 B2 12/2005 Williamson, IV et al.
D519,183 S 4/2006 Minneman
7,032,494 B2 4/2006 Wygant
D521,100 S 5/2006 Morrow
7,043,862 B2 5/2006 Franks
7,055,279 B2 6/2006 Flores
7,062,979 B2 6/2006 Day et al.
D524,541 S 7/2006 Cauley
7,086,192 B2 8/2006 Deras
7,104,398 B1 9/2006 Wisecarver
7,134,663 B1 11/2006 Lowe et al.
7,143,986 B1 12/2006 Austin et al.
7,152,355 B2 12/2006 Fitzpatrick et al.
7,152,358 B1 12/2006 LeAnna et al.
7,159,711 B1 1/2007 Gardner
7,165,750 B2 1/2007 McCuskey et al.
7,188,445 B2 3/2007 Lehman
D540,904 S 4/2007 Werner
7,200,966 B2 4/2007 Gooder
7,201,376 B2 4/2007 Kuosa
7,207,567 B1 4/2007 Brown
D543,604 S 5/2007 Minneman
7,213,494 B2 5/2007 James
7,216,404 B1 5/2007 Doyle
7,222,451 B2 5/2007 Keng et al.
7,225,050 B2 5/2007 Sutula, Jr.
7,246,704 B2 7/2007 Brunson et al.
7,258,345 B2 8/2007 Anderson, Jr.
D553,219 S 10/2007 Potterfield
7,281,346 B1 10/2007 Cook et al.
D567,895 S 4/2008 Cauley
7,356,960 B1 4/2008 Knitt
7,356,961 B2 4/2008 Williams
7,357,250 B2 4/2008 Hagemann
7,363,740 B2 4/2008 Kincel
7,367,451 B2 5/2008 Pendergraph et al.
7,401,431 B2 7/2008 Pierce et al.
7,410,053 B2 8/2008 Bowen et al.
D576,245 S 9/2008 Potterfield et al.
7,421,815 B1 9/2008 Moody et al.
7,426,800 B2 9/2008 Pierce et al.
7,431,247 B2 10/2008 Bobro
7,481,015 B2 1/2009 Mays
7,536,819 B2 5/2009 Popikow
7,536,820 B2 5/2009 Wade et al.
7,549,247 B1 6/2009 Reese
7,584,690 B2 9/2009 Cauley
D605,246 S 12/2009 Hobbs
7,631,455 B2 12/2009 Keng et al.
7,631,877 B2 12/2009 Zara
7,654,498 B1 2/2010 Beltz
7,658,140 B2 2/2010 Lombardi
7,665,241 B2 2/2010 Oz
7,676,977 B1 3/2010 Cahill et al.
7,681,886 B2 3/2010 Morrow et al.
7,694,973 B1 4/2010 Hofmeister
7,713,180 B2 5/2010 Wickens et al.
7,726,478 B2 6/2010 Potterfield et al.
7,730,824 B1 6/2010 Black
7,743,544 B2 6/2010 Laney et al.
7,774,972 B2 8/2010 Potterfield et al.
7,779,572 B2 8/2010 Potterfield et al.
7,823,317 B2 11/2010 Potterfield et al.
7,845,267 B2 12/2010 Potterfield et al.
7,866,081 B2 1/2011 Seuk
7,883,396 B2 2/2011 Potterfield et al.
7,954,272 B2 6/2011 Potterfield et al.
7,997,021 B2 8/2011 Cauley
8,011,129 B2 9/2011 Cauley et al.
8,104,212 B2 1/2012 Potterfield et al.
8,109,028 B2 2/2012 Roberts et al.
8,132,351 B2 3/2012 Potterfield et al.
8,296,988 B2 10/2012 Vale et al.
8,336,708 B2 12/2012 Potterfield et al.
8,356,442 B2 1/2013 Potterfield et al.
8,371,057 B2 2/2013 Coffield et al.
8,444,056 B2 5/2013 Gamez et al.
8,496,212 B2 7/2013 Keng et al.
8,621,773 B2 1/2014 Morrow et al.
8,683,730 B1 4/2014 Moore
9,151,561 B2 10/2015 Morrow et al.
9,618,291 B1 * 4/2017 Henderson ..... F41A 23/02
9,702,653 B2 * 7/2017 Cauley, Jr ..... F41A 23/16
10,317,162 B2 6/2019 Morrow et al.
10,328,322 B1 * 6/2019 King ..... A63B 71/0036
10,782,085 B2 * 9/2020 Cauley, Jr ..... F41A 23/12
2002/0195752 A1 12/2002 Yang
2003/0234205 A1 12/2003 McGuyer et al.
2004/0112777 A1 7/2004 Huang
2004/0134113 A1 7/2004 Deras et al.
2005/0000141 A1 * 1/2005 Cauley ..... F41A 23/16 42/94
2005/0115137 A1 * 6/2005 Minneman ..... F41A 23/16 42/94
2006/0065560 A1 3/2006 Dickenson et al.
2006/0175213 A1 8/2006 Hurt et al.
2006/0230664 A1 10/2006 Eddins
2006/0254111 A1 11/2006 Giauque et al.
2006/0277811 A1 12/2006 Peterson
2007/0051028 A1 3/2007 Stordal
2007/0068379 A1 3/2007 Sween et al.
2007/0068835 A1 3/2007 Buie, III
2007/0074439 A2 4/2007 Cauley et al.
2007/0094911 A1 5/2007 Rush et al.
2007/0113460 A1 5/2007 Potterfield et al.
2007/0234623 A1 10/2007 Carney
2007/0256346 A1 11/2007 Potterfield et al.
2007/0295197 A1 12/2007 Potterfield
2008/0023379 A1 1/2008 Potterfield et al.

(56) References Cited

U.S. PATENT DOCUMENTS

| | | | | |
|---|---|---|---|---|
| 2008/0054570 | A1 | 3/2008 | Potterfield et al. | |
| 2008/0061509 | A1 | 3/2008 | Potterfield | |
| 2008/0128002 | A1 | 6/2008 | Jeffs | |
| 2008/0156671 | A1 | 7/2008 | Jansson | |
| 2008/0174071 | A1 | 7/2008 | Potterfield et al. | |
| 2008/0178641 | A1 | 7/2008 | Himmen | |
| 2008/0263928 | A1 | 10/2008 | Potterfield | |
| 2009/0025267 | A1* | 1/2009 | Reinert | F41A 35/00 42/94 |
| 2009/0126250 | A1 | 5/2009 | Keng | |
| 2009/0188146 | A1 | 7/2009 | Werner | |
| 2010/0102178 | A1 | 4/2010 | Smith et al. | |
| 2010/0126055 | A1 | 5/2010 | Potterfield | |
| 2010/0138032 | A1 | 6/2010 | Potterfield | |
| 2010/0236125 | A1* | 9/2010 | Morrow | F41A 23/02 42/94 |
| 2010/0270201 | A1 | 10/2010 | Cauley et al. | |
| 2011/0024985 | A1 | 2/2011 | Potterfield et al. | |
| 2011/0036214 | A1 | 2/2011 | Potterfield | |
| 2011/0094140 | A1 | 4/2011 | Letson | |
| 2011/0192069 | A1* | 8/2011 | Potterfield | F41A 23/16 42/94 |
| 2012/0175844 | A1 | 7/2012 | Potterfield | |
| 2012/0186125 | A1* | 7/2012 | Werner | F41A 23/18 42/94 |
| 2013/0086835 | A1 | 4/2013 | Minneman | |
| 2014/0237882 | A1 | 8/2014 | Banes et al. | |
| 2015/0354913 | A1 | 12/2015 | Morrow et al. | |
| 2016/0193518 | A1* | 7/2016 | Baxter | A63B 24/0062 473/450 |
| 2017/0102203 | A1* | 4/2017 | Cauley, Jr | F41A 23/16 |
| 2019/0285376 | A1* | 9/2019 | Bales | F41A 23/16 |
| 2020/0033089 | A1* | 1/2020 | Morrow | F41A 23/16 |

OTHER PUBLICATIONS

Joe's, "Shooter's Ridge Steady Point Shooting Rest," http://www.joessports.com/product/index.jsp?productId=3155005&cp=726872&parentPag . . . , Item No. 3155005, 1 pg. [Internet accessed Jul. 17, 2008].

Lahti Company Brochure, "Rifle Evaluator: No Pain, No Fear, No Flinching, No Body Movement," www.lahticompany.com, 2 pgs., Undated.

Lahti Company, Evaluator Brochure, http://www.lathicompany.com/Forms/EvaluatorBrochure2.jpg, 2 pgs., accessed Jan. 16, 2006.

MacksPW.com, "Desert Mountain Bench Master Rifle Rest," http://www.macksqw.com/Item-i-DESBM1, ©2004-2008, 1 pg. [Internet accessed Jul. 22, 2008].

Midway USA, "Shooters Ridge Steady Point Rifle Shooting Rest," http://www.midwayusa.com/eproductpage.exe/showproduct?saleitemid=826745&t=11082005, 2005, 5 pgs. [Internet accessed on Aug. 6, 2008].

Midway USA. "Tipton Range Box with Ultimate Rifle, Handgun Cleaning Kit (No Solvents)". <URL: http://www.midwayusa.com/rewriteaproducU135086>. 2 pgs. The date on which the Tipton Range Box was first on sale is not known, but is believed to be circa 2004.

MidwayUSA, "ADG Rifle Shooting Rest," http://www.midwayusa.com/eproductpage.exe/showproduct?saleitemid=992071&t=11082005, 2005, 3 pgs. [Internet accessed on Aug. 6, 2008].

MidwayUSA, "Caldwell Full Length Fire Control Shooting Rest," http://www.midwayusa.com/eproductpage.exe/showproduct?saleitemid=683866&t=11082005, 2005, 3 pgs. [Internet accessed on Aug. 6, 2008].

MidwayUSA, "Caldwell Lead Sled DFT Rifle Shooting Rest," http://www. midwayusa.com/eproductpage.exe/showproduct?saleitemid=149023&t=11082005, 2005, 6 pgs. [Internet accessed on Aug. 6, 2008].

MidwayUSA, "Caldwell Lead Sled Rifle Shooting Rest," http://www.midwayusa.com/eproductpage.exe/showproduct?saleitemid=152664&t=11082005, 2005, 8 pgs. [Internet accessed on Aug. 6, 2008].

MidwayUSA, "Caldwell Steady Rest NXT Rifle Shooting Rest," http://www.midwayusa.com/eproductpage.exe/showproduct?saleitemid=838651&t=11082005, 2005, 4 pgs. [Internet accessed on Aug. 6, 2008].

MidwayUSA, "Caldwell Zero-Max Rifle Shooting Rest," http://www.midwayusa.com/eproductpage.exe/showproduct?saleitemid=726222&t=11082005, 2005, 3 pgs. [Internet accessed on Aug. 6, 2008].

MidwayUSA, "CTK Precision P3 Ultimate Shooting Rest," http://www.midwayusa.com/eproductpage.exe/showproduct?saleitemid=1146998t=11082005, 2005, 2 p. [Internet accessed on Aug. 6, 2008].

MidwayUSA, "Hyskore® dangerous Game Rifle Shooting Rest," http://www.midwayusa.com/eproductpage.exe/showproduct?saleitemid=729197&t=11082005, 2005, 3 pgs. [Internet accessed on Aug. 6, 2008].

MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 3 pgs. [Internet accessed on Aug. 6, 2008].

MidwayUSA, "Hyskore® Swivel Varmint Rifle Shooting Rest," http://www.midwayusa.com/eproductpage.exe/showproduct?saleitemid=587606&t=11082005, 2005, 3 pgs. [Internet accessed on Aug. 6, 2008].

MidwayUSA, "Shooters Ridge Steady Point Rifle Shooting Rest with Vise," http://www.midwayusa.com/eproductpage.exe/showproduct?saleitemid=341095&t=11082005, D 2005, 4 pgs. [Internet accessed on Aug. 6, 2008].

MidwayUSA, "Shooting Supplies—Shop Everything for Your Firearm at MidwayUSA," http://www.midwayusa.com/browse/BrowseProducts.aspx?categoryStrin . . . , 15 pgs. [Internet accessed on Jul. 21, 2008].

MidwayUSA, "Stoney Point Bench Anchor Rifle Shooting Rest," http://www.midwayusa.com/eproductpage.exe/showproduct?saleitemid=347174&t=11082005, 2005, 2 pgs. [Internet accessed on Aug. 6, 2008].

Milek, B., "Handloading for Hunting" New Products from RGBS, Lee, Accurate Arms, Peterson's Hunting, Mar. 1985, p. 21. 1 pg.

Millett, "BenchMaster Shooting Rests," 1 pg. Undated.

MTM Case-Gard. "Gun Maintenance Centers." 2 pgs. The date on which the MTM Gun Maintenance Center was first on sale is not known, but is believed to be circa 2004.

MTM Case-Gard. "Rifle rest and pistol shooting rest". <URL: http://www.mtmcasegard.com/products/shooting/shoo.html>. 3 pgs. The date on which the MTM Site-In-Clean was first on sale is not known, but is believed to be circa 2004.

MTM Shoulder-Gard Rifle Rest, MTM Case-Gard, p. 2 "Rests", 1 pg.

Precision Shooting, Inc., Bald Eagle Front Rest, The Accurate Rifle, vol. 6, Issue No. 4, May 2003, p. 47. 1 pg.

Protektor Model, "The Original Leather Rifle and Pistol Rest," http://www.protektormodel.com/, 12 pgs. [Internet accessed on Feb. 14, 2006].

Shooters Ridge, "Deluxe Rifle Rest," http://www.shootersridge.com, 1 pg. [Internet accessed Jul. 21, 2008].

Shooters Ridge, "Shooting Rest with Gun Vise," http://www.shootersridge.com, 1 pg. [Internet accessed Jul. 17, 2008].

Sinclair International, Sinclair Shooting Rests, Products for the Precision Shooter, 2002, Issue No. 2002-B, pp. 76-78.

Sweeney, P "Gunsmithing: Measure Headspace," Peterson's Rifleshooter, http://www.rifleshootermag.com/gunsmithing/headspace_0612/, 4 pgs. [Internet Accessed Dec. 11, 2004].

Tenex Precision Co. "Recoil A-Rest-R" Product Pictures, 4 sheets, Riverside CA.

The Sportsman's Guide. "Plano Shooters Case!" <URL: http://www.sportsmansguide.com/cb/cb.asp?a=148225>. 3 pgs. The date on which the Plano Shooters Case was first on sale is not known, but is believed to be circa 2004.

Cabela's, "Sharp Shooter Rifle Rest," http://www.cabelas.com/cabelas/en/templates/links/link.jsp?id=0005816222738a&type=product&cmCat=, © 1996-2008, 2 pgs. [Internet accessed on Aug. 6, 2008].

(56) References Cited

OTHER PUBLICATIONS

"American Rifleman: What to do about recoil," LookSmart, http://www.findarticles.com/p/articles/mi_qa3623/is_199907/ai_n886159/print, pp. 1-4, accessed Jan. 4, 2006.
"Cleaning Cradles: Sinclaire Cleaning Cradles" p. 21. 1 pg. The date on which the Sinclair Folding Cleaning Cradle was first on sale is not known, but is believed to be circa 2004.
"Decker Rifle Vise", 1 pg. The date on which the Decker Rifle Vise was first on sale is not known, but is believed to be circa 2004.
"The Grabber and Hustler '76," MEC—Mayville Engineering Company, Inc., 2 pgs., undated.
"Uncle Bud's Bull Bags," http:www.unclebudscss.com/pages/Bulls%20bags.html, 2 pgs. [Internet accessed on Feb. 14, 2006].
"Uncle Bud's Udder Bag," http:www.unclebudscss.com/pages/Udder%20Bags.html, 2 pgs. [Internet accessed on Feb. 14, 2006].
1Shop2.com. "Hoppe's Gunsmith's Fully Adjustable Bench Vise", 3 pgs. The date on which The Hoppe's Gunsmith's Fully Adjustable Bench Vise was first on sale is not known, but is believed to be circa 2004.
AcuSport Outdoor Sporting Products, 3 pgs.
Amazon.com, "CTK® P3 Ultimate Shooting Rest," Sports & Outdoors, http://www.amazon.com/CTK%C2%AE-P3-Uitimate-Shooting-Rest/dp/. . . , 1 pg. [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 pg. [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/BO . . . , 1 pg. [Internet accessed on Jul. 22, 2008].
Basspro.com, "Bass Pro Shops Outdoors Online: Offering the best in Fishing, Hunting and Outdoor Products," http://www.basspro.com/webapp/wcs/stores/servlet/Product 10151 -1 10001 95064 SearchResults, 2 pgs. [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," file://C:\DOCUME-1\DUTCD\LOCALS-1\Temp\PQ28V28J.htm, 1 pg., accessed Jan. 25, 2006.
Big Boy Gun Toys, "Shooting Rest," http://www.bigboyguntoys.com/shootingrest.htm, 1 pg. [Internet accessed on Jul. 18, 2008].
Boyt Hamess Company, Product Catalog, http://www.boytharness.com/catalog/index.php?cPath=22, 2 pgs. [Internet accessed on Jul. 21, 2008].
Brownells, Inc., Catalog No. 41, 1988-1989, 3 pgs.
Brownells, Inc., Catalog No. 57, 2004-2005, 2 pgs.
Brownells, Inc., Catalog No. 47, 1994-1995, 2 pgs.
Brownells, Inc., Sight Base Cutters, Faxed Dec. 17, 2003, 1 pg.
Cabela's Hunting Fishing and Outdoor Gear Master Catalog, Fall2002, Edition II, Minimizer Rifle Rest, Item No. SC-22-4332 and SC-22-4333, p. 492.
Cabela's: Worid's Foremost Outfitter. "HySkore Sighting System and Cleaning Vise". 1 pg. The date on which the HySkore Sighting System and Cleaning Vise was first on sale is not known, but is believed to be circa Jan. 2005. However, a prototype of this product may have been shown to buyers at Cabela's circa Aug. 2004.
Cabela's. "Master Catalog Fall 2003: Late-Season Edition". Cover page and p. 416. 2 pgs.
Cabela's, "BenchBuddy@ Gun Rest," http://www.cabelas.com/cabelas/en/templates/links/link.jsp?id=0005819221954a&type=product&cmCat=, © 1996-2008, 2 pgs. [Internet accessed on Aug. 6, 2008].
Cabela's, "Elite Rifle Rest," http://www.cabelas.com/cabelas/en/templates/links/link.jsp?id=0005817227855a&type=product&cmCat=, © 1996-2008, 2 pgs. [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pgs. [Internet accessed on Aug. 6, 2008].
Cabela's, "Hyskore® Ultimate Sighting Rest," http://www.cabelas.com/cabelas/en/templates/links/link.jsp?id=0024152226083a&type=product&cmCat=, © 1996-2008, 2 pgs. [Internet accessed on Aug. 6, 2008].
Cabela's, "Nitro Shoulder Shield Rest," http://www.cabelas.com/cabelas/en/templates/links/link.jsp?id=0040862228231a&type=product&cmCat=, © 1996-2008, 2 pgs. [Internet accessed on Aug. 6, 2008].
Cabela's, "Premier Rifle Rest," http://www.cabelas.com/cabelas/en/templates/links/link.jsp?id=0020904227856a&type=product&cmCat= . . . , © 1996-2008, 2 pgs. [Internet accessed on Aug. 6, 2008].
Cabela's, "Secure Bench Rest," hnttp://www.cabelas.com/cabelas/en/templates/links/link.jsp:jsessionid=4F0LP0OW2HMRLLAOBBISCOF . . . , © 1996-2008, 2 pgs. [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pgs. [Internet accessed on Aug. 6, 2008].
Cabela's, "Shooting Benches & Portable Rifle Shooting Bench Rest," http://www.cabelas.com/ssubcat-1/cat20793.shtml, 3 pgs [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pgs. [Internet accessed on Jul. 15, 2008].
Caldwell Shooting Supplies, 2006 Catalog, pp. 18, 5, 12, 14 and 15. 5 pgs.
Califomiavarmintcallers.com—Forum, http://califomiavarmintcallers.com/community/modules/newbb/viewtopic.php?topic_id=10&forum=9&PHPSESSID=074ed8c7 . . . pp. 1-4 accessed Jan. 16, 2006.
Canadian Camo, "Gun Rest," https://media5.magma.ca/www.canadiancamo.com/catalog/product_info.php?products_id= . . . , 2 pgs. [Internet accessed on Feb. 13, 2006].
Champion Traps & Target, 2005 Product Catalog, 12 pgs.
Hyskore: Professional Shooting Accessories, "Hydraulic Trigger Release," www.hyskore.com, 7 pgs. [Internet accessed Feb. 22, 2006].
CTK Precision, All Products, http://www.ctkprecision.com/index.asp?PageAction=VI EWCATS&Cate . . . , 3 pgs. [Internet accessed on Jul. 22, 2008].
Cv-500, 3 pgs. [product photos].
E. Arthur Brown Company, "A Shooting Rest that Really Works . . . ," http://www.eabco.comfTargetShooting01.html, ©2007-2008, 1 pg. [Internet accessed Jul. 18, 2008].
Edgewood Shooting Bags Catalog, http://www.edgebag.com/catalog.php, 7 pgs. [Internet accessed on Feb. 14, 2006].
Ellett Brothers, Rests & Gun Vises, 3 pgs.
Four photos of the Lohman Sight Vise. 4 pgs. The date on which the Lohman Sight Vise was first on sale is not known, but is believed to be circa 2004.
Grafix® Plastics, http://www.grafixplastics.com/plastic_film_g.asp?gclid=CK-5-7gnY4CFRVNhQodjFhfSQ, 29 pgs. [Internet accessed on Aug. 30, 2007].
"Gun Rest-Shooting Rest-Rifle Rests," http://www.exploreproducts.com/gunrests-shootingrests.htm, 6 pgs. [Internet accessed Jul. 18, 2008].
Hyskore, "Rest—Dangerous Game Machine Rest," Hyskore Rest, Professional firearm rests, http://www.hyskore.com/rests.htm, 2 pgs. [Internet accessed Jul. 21, 2008].
Hyskore: Professional Shooting Accessories, "Dangerous Game Machine Rest," www.hyskore.com, 10 pgs [Internet accessed Feb. 22, 2006].

* cited by examiner

RECOIL-REDUCING FIREARM SHOOTING REST HAVING TANK

FIELD

The present disclosure generally relates to firearm accessories, and more particularly to rests for firearms.

BACKGROUND

Firearm shooting sports are often associated with painful recoil that can result from shooting firearms. A large caliber, heavy recoiling firearm can create an unpleasant experience when firing more than a few rounds. Recoil can be described as the equal and opposite reaction to the momentum of an ammunition cartridge's projectile (e.g., bullet) and gunpowder charge upon firing of the cartridge. This momentum is imparted to the firearm, causing it to travel in the opposite direction of the fired bullet.

Shooters commonly use a shooting rest for supporting a firearm in a steady position when practicing with or sighting-in the firearm. Even when using a shooting rest, flinching or jerking the trigger in anticipation of recoil is a common negative factor in a shooter's accuracy and can present challenges when attempting to sight-in the firearm. Shooters commonly fire upwards of twenty rounds when sighting-in, especially in the case of rifles and shotguns using telescopic sights. To reduce discomfort and inaccuracy resulting from recoil, some shooting rests are configured to absorb recoil to reduce the recoil force felt by the shooter.

SUMMARY

In one aspect, a recoil-reducing shooting rest can be used by a shooter when shooting a firearm having a forward portion and a rearward portion. The shooting rest comprises a frame and a forward firearm support connected to the frame. The forward firearm support is configured to support the forward portion of the firearm. A rear firearm support is connected to the frame and configured to support the rearward portion of the firearm. The rear firearm support includes a stop configured to inhibit rearward movement of the firearm with respect to the frame when the firearm is supported by the forward and rear firearm supports and fired. A liquid tank formed separately from and supported by the frame includes a container having a top, a bottom, a front end, a rear end, and opposite left and right sides. The container has an interior and is configured to hold a volume of liquid in the interior to increase an effective mass of the shooting rest to reduce recoil felt by the shooter when the firearm is supported by the shooting rest and fired. The container includes a liquid port in fluid communication with the interior of the container. The liquid tank including a cover configured to selectively open and close the liquid port.

In another aspect, a recoil-reducing shooting rest can be used by a shooter when shooting a firearm having a forward portion and a rearward portion. The shooting rest comprises a frame and a forward firearm support connected to the frame. The forward firearm support is configured to support the forward portion of the firearm. A rear firearm support is connected to the frame and configured to support the rearward portion of the firearm. The rear firearm support includes a stop configured to inhibit rearward movement of the firearm with respect to the frame when the firearm is supported by the forward and rear firearm supports and fired. A liquid tank formed separately from and supported by the frame includes a container having an interior and configured to hold a volume of liquid in the interior to increase an effective mass of the shooting rest to reduce recoil felt by the shooter when the firearm is supported by the shooting rest and fired. The container includes a liquid port in fluid communication with the interior. The container has a top, a bottom, a front end, a rear end, and opposite left and right sides. The front end of the container is located forward from the rear firearm support. The container extends rearward from the front end of the container toward the rear firearm support. The frame is in engagement with a downward facing surface of the container to prevent movement of the container with respect to the frame in a downward direction. The frame is in engagement with a forward facing surface of the container to prevent movement of the container with respect to the frame in a forward direction. The frame is in engagement with a rearward facing surface of the container to prevent movement of the container with respect to the frame in a rearward direction. The frame is in engagement with a leftward facing surface of the container to prevent movement of the container with respect to the frame in a leftward direction. The frame is in engagement with a rightward facing surface of the container to prevent movement of the container with respect to the frame in a rightward direction In yet another aspect, a method of manufacturing a recoil-reducing firearm shooting rest comprises providing a liquid container having an interior and configured to hold liquid in the interior. The method includes assembling a frame around the liquid container to capture the liquid container in the frame to maintain a position of the container with respect to the frame. A forward firearm support is secured to the frame. The forward firearm support is configured to support a forward portion of a firearm. A rear firearm support is secured to the frame. The rear firearm support is configured to support a forward portion of the firearm. The rear firearm support includes a stop configured to inhibit rearward movement of the firearm with respect to the frame when a firearm is supported by the forward and rear firearm supports and fired.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
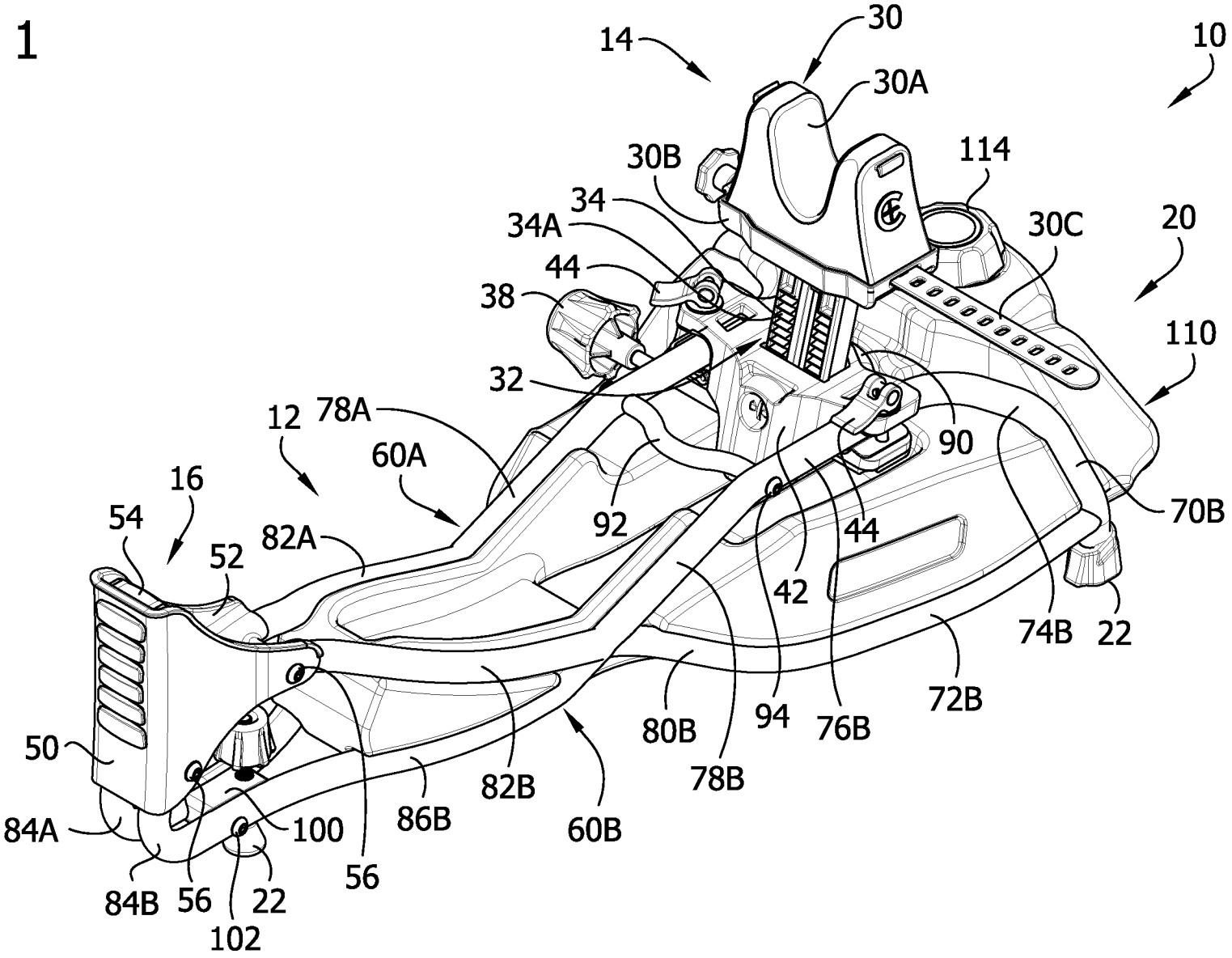
FIG. 1 is a rear perspective of a shooting rest.

Referring to FIG. 1, a shooting rest is designated generally by the reference number 10. The shooting rest 10 is constructed for supporting a firearm (not shown) in a shooting position so a user can fire the firearm while it is supported by the shooting rest. As will become apparent, the shooting rest 10 assists the user in holding the firearm steady while aimed at a target, and the shooting rest is configured for reducing recoil felt by the user when the firearm is fired.

As shown in FIG. 1, the rest 10 includes a frame, generally indicated by the reference number 12, and forward and rear firearm supports, generally indicated by the reference numbers 14 and 16, respectively. The forward and rear supports 14, 16 are connected to the frame 12 and positioned with respect to each other for supporting respective forward and rear portions of a firearm. For example, the forward portion of the firearm could include a barrel and/or forestock of the firearm. The rear portion of the firearm could include a buttstock having a butt.

A weight support 20 for holding additional weight is supported by the frame 12. It will be understood that additional weight supported by the weight support 20 can increase the effective mass of the shooting rest 10 for absorbing recoil force when the firearm is fired. For example, various types of weight supports for supporting removable weight on firearm rests are disclosed in U.S. Pat. Nos. 8,011,129 and 8,621,773, which are hereby incorporated by reference in their entireties. In the embodiment illustrated herein, the weight support is provided in the form of a tank 20 for holding water or another liquid. It will be appreciated that other flowable material, such as sand, lead shot, etc. could be used instead of liquid without departing from the scope of the present invention. The tank 20 will be described in further detail below.

The rest 10 has three feet 22 for supporting the rest on a support surface such as a table top or bench top. Two forward feet 22 are provided, and one rear foot 22 is provided. The feet 22 are configured to support the tank 20 spaced above the support surface. It will be appreciated that other arrangements for supporting the shooting rest 10 can be used without departing from the scope of the present invention.

Referring to FIG. 1, the forward support 14 includes a cradle 30 for receiving the forward portion of the firearm and a height adjustment assembly 32 configured for adjusting a vertical position of the cradle with respect to the frame 12. In the illustrated embodiment, the cradle 30 includes a generally U-shaped pad 30A formed of thermoplastic material mounted on a base plate 30B. A flexible strap 30C is secured to the base plate 30B and is extendable over the pad 30A and securable to the cradle 30 to secure the firearm in the cradle. The height adjustment assembly 32 includes a post 34 having a rack 34A thereon for engagement by a pinion 36 (FIG. 9) rotatable by a height adjustment actuator 38 to raise and lower the cradle 30. An adjustable biasing member 40 (FIG. 9) applies an adjustable biasing force against the post 34 to maintain the post in a vertical position to which the post is moved by the pinion 36. Similar height adjustment assemblies are disclosed in U.S. Pat. Nos. 7,997,021 and 8,393,106, which are hereby incorporated by reference in their entireties.

The post 34 is supported by a hub 42 movable forward and rearward on the frame 12 to change a distance between the forward and rear firearm supports 14, 16. Two clamp assemblies are provided at opposite sides of the hub 42 for selectively clamping the frame 12 to lock the hub in a selected position along the frame. The illustrated clamp assemblies each include a cam lever 44 attached to a bolt extending from an upper jaw of the clamp to a lower jaw of the clamp. When the cam levers 44 are in unclamped positions (not shown), the upper and lower jaws are spaced from one another to permit the forward firearm support 14 to slide forward or rearward on the frame 12 relative to the rear support 16. The cam levers 44 are movable from the unclamped positions to clamped positions (e.g., FIG. 1) to draw the lower jaws toward the upper jaws to clamp the frame 12 in the jaws. When the cam levers 44 are in the clamped positions, cams on the cam levers engage the upper jaw to hold the cam levers in the clamped positions and thus hold the forward support 14 in position on the frame 12. Similar connections of a forward firearm support to a frame of a firearm rest are disclosed in U.S. Pat. No. 8,621,773, which is hereby incorporated by reference in its entirety. Other types of forward supports can be used without departing from the scope of the present invention.

Figure 2:
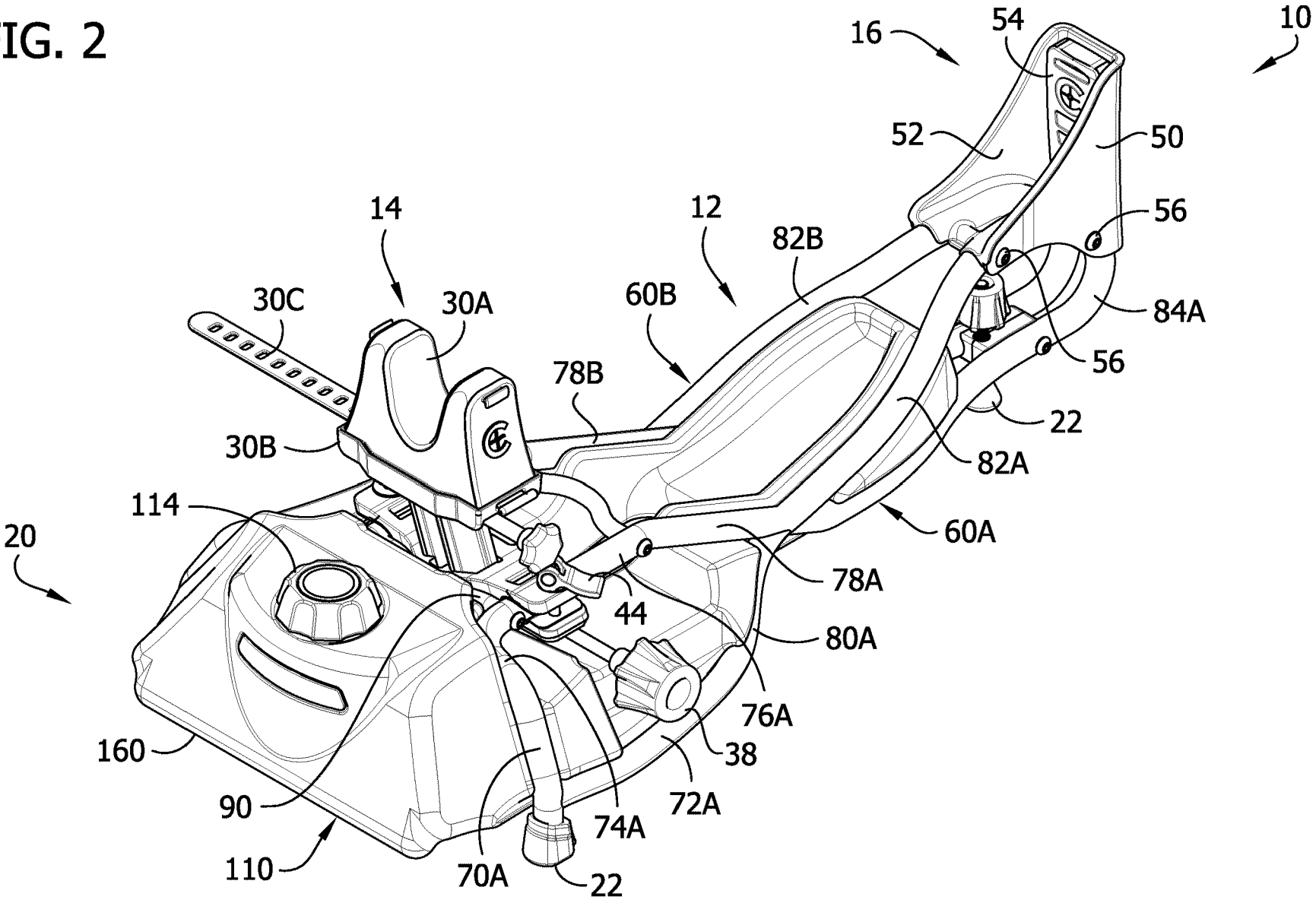
FIG. 2 is a front perspective of the shooting rest.
Figure 3:
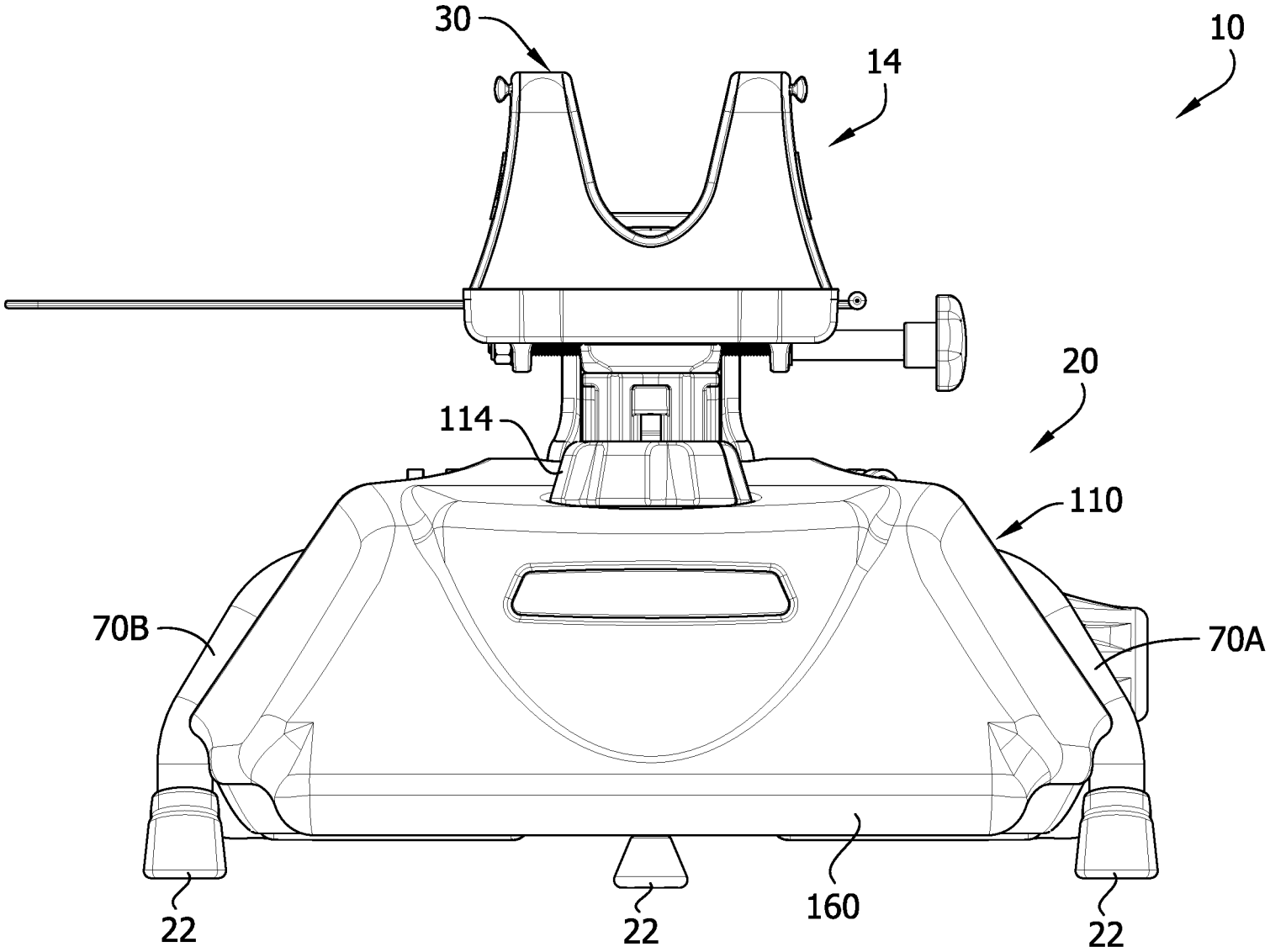
FIG. 3 is a front elevation of the shooting rest.
Figure 4:
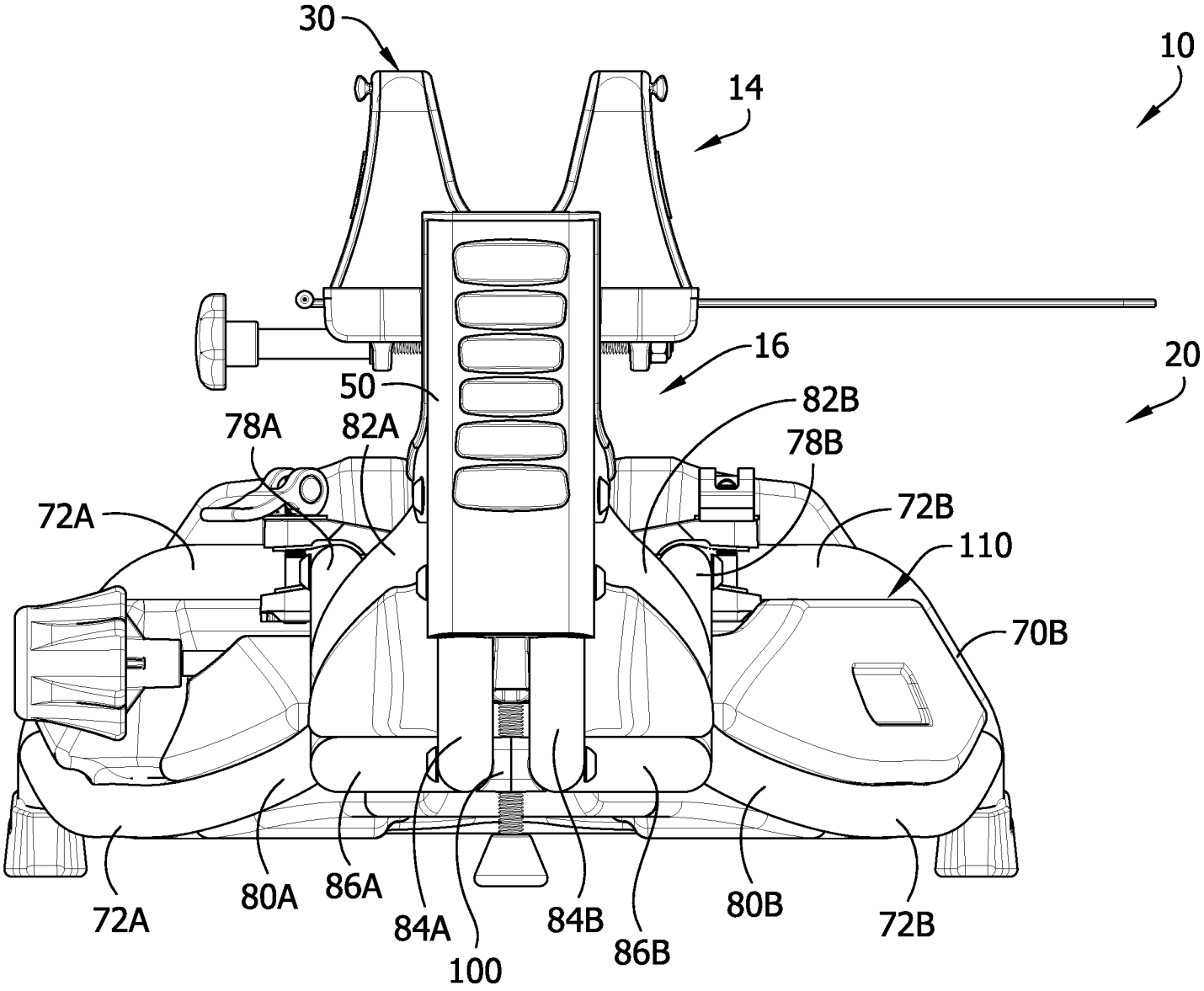
FIG. 4 is a rear elevation of the shooting rest.
Figure 5:
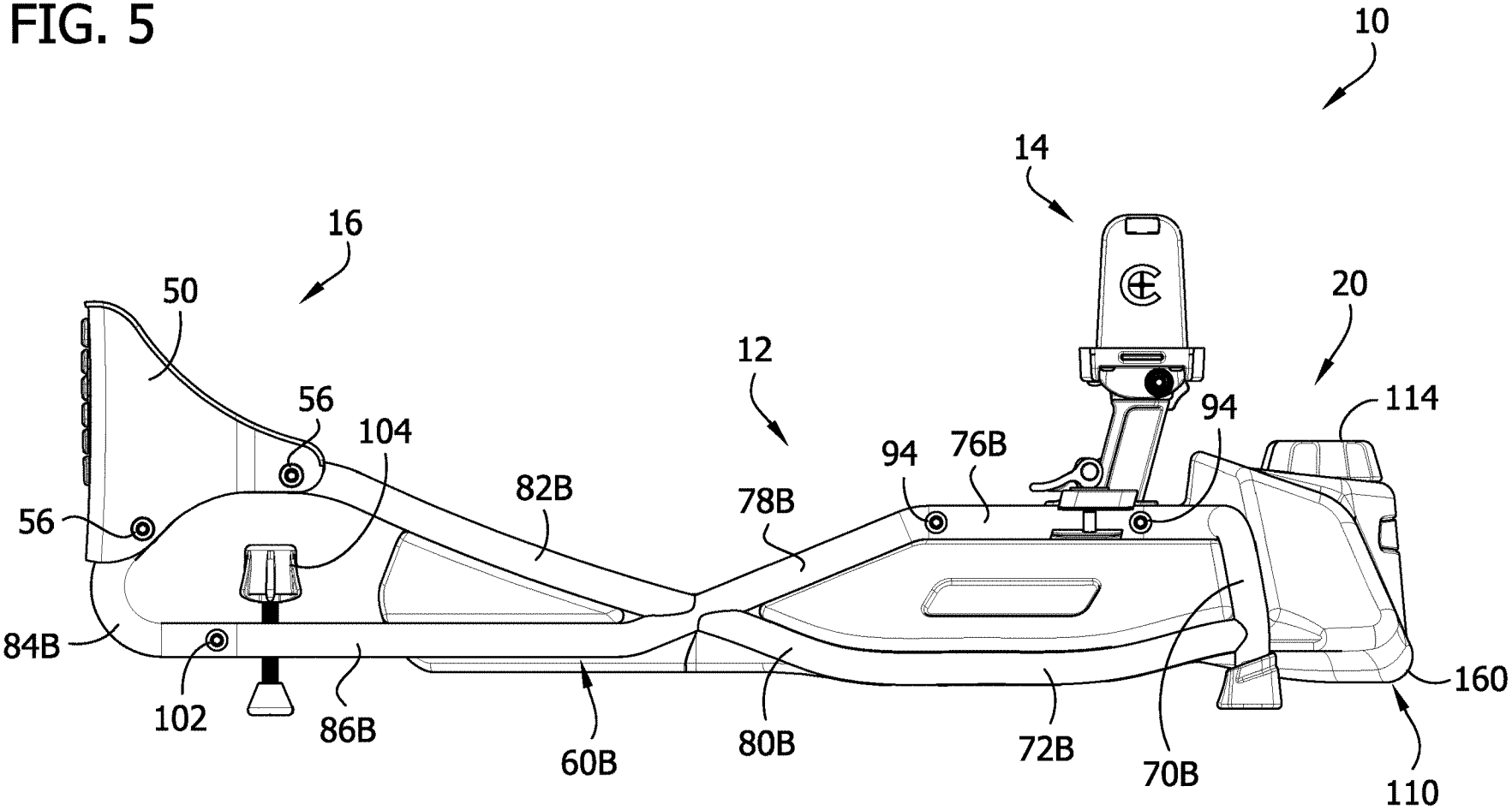
FIG. 5 is a right elevation of the shooting rest.
Figure 6:
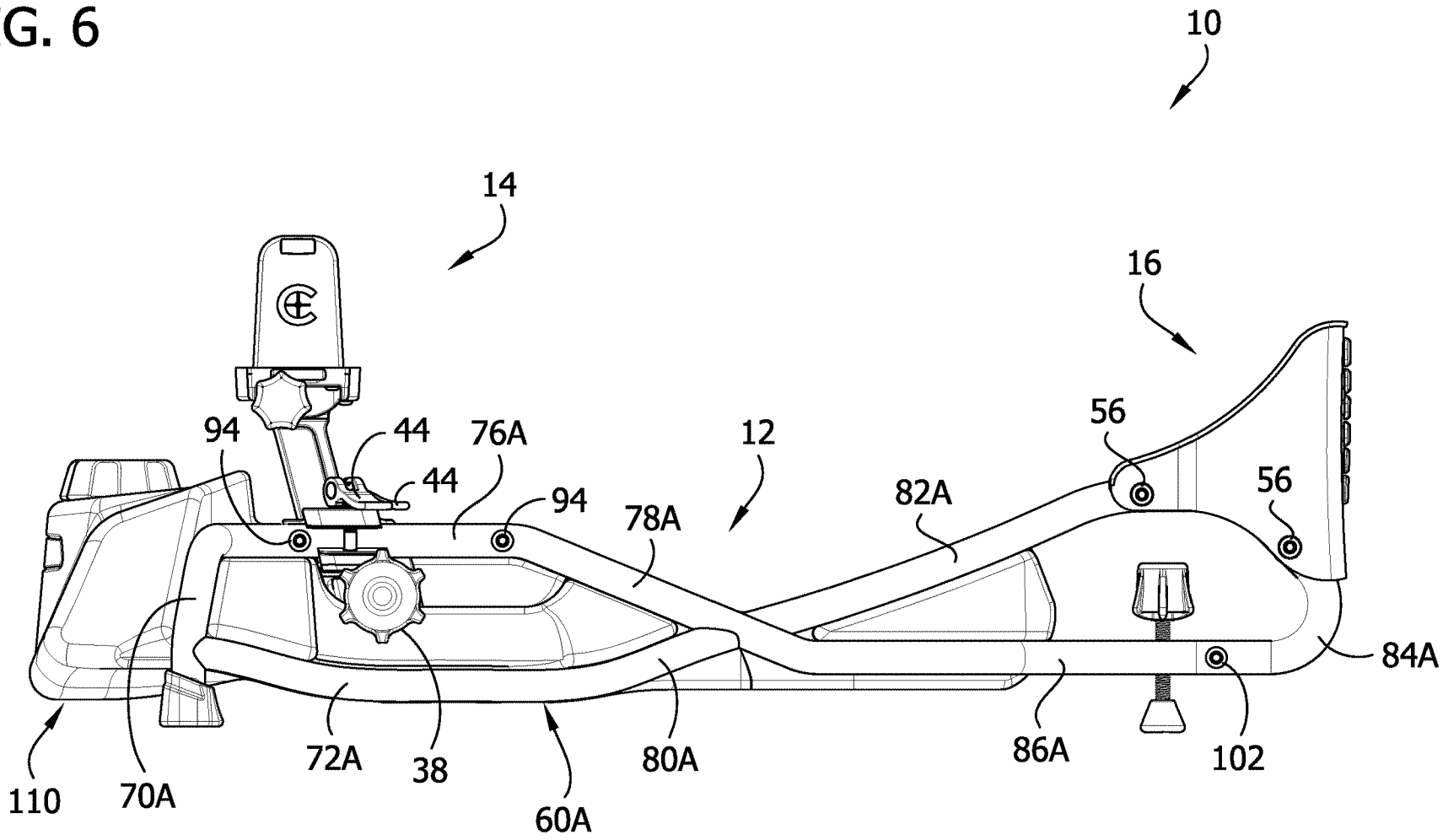
FIG. 6 is a left elevation of the shooting rest.
Figure 7:
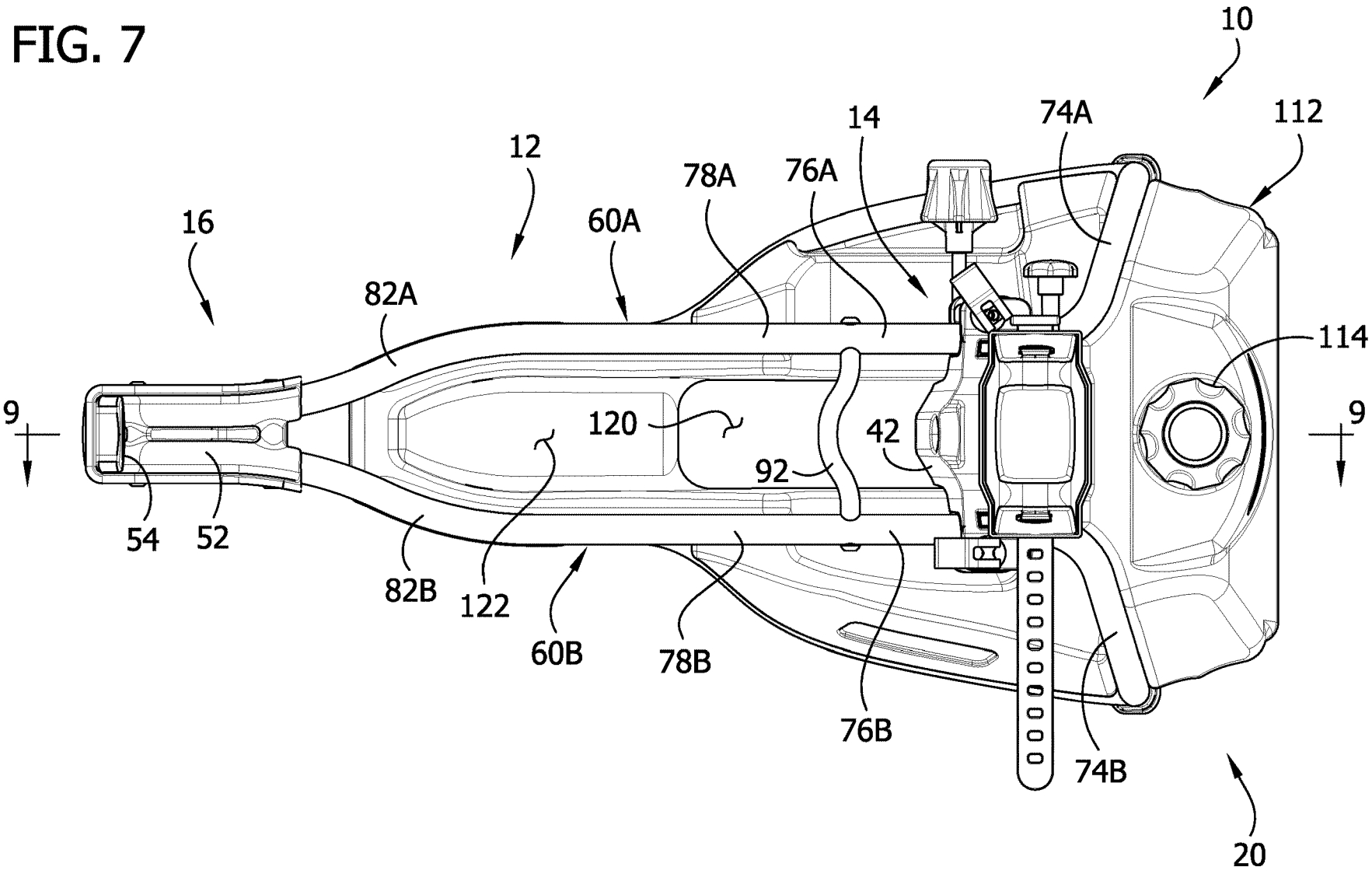
FIG. 7 is a top view of the shooting rest.
Figure 9:
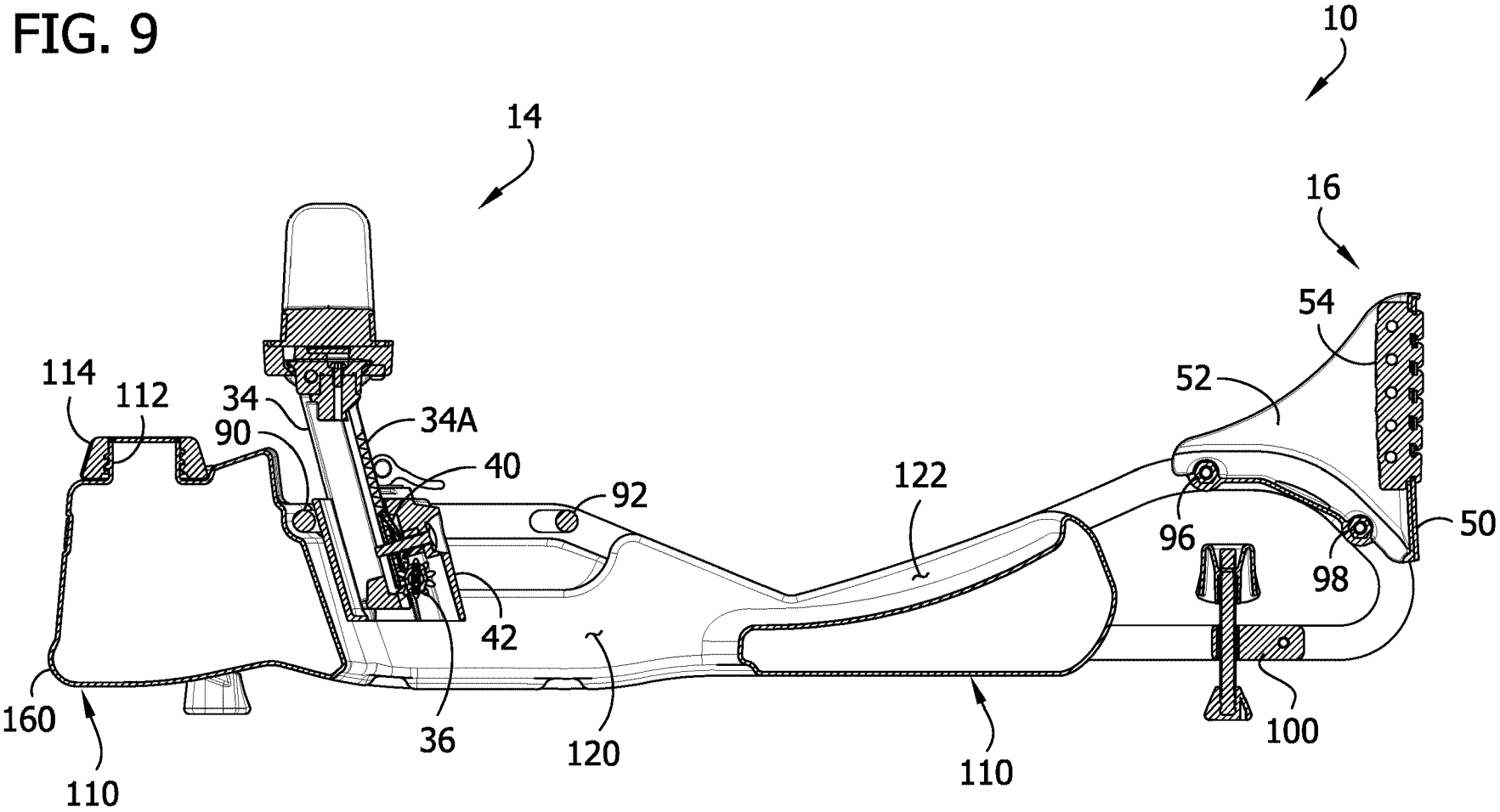
FIG. 9 is a section of the shooting rest taken in a plane including line 9-9 of FIG. 7.

Referring now to FIGS. 2 and 9, the rear support 16 defines a pocket sized for receiving a portion of the buttstock of the firearm, including the butt of the firearm. In the illustrated embodiment, the rear support 16 comprises an assembly including a stop 50, a cover 52, and a recoil pad 54. The stop 50 is configured to inhibit rearward movement of the firearm relative to the frame 12 when the firearm is fired. The stop 50 can be formed of rigid metal or another suitable material (e.g., fabric sling) connected to the frame. The illustrated stop 50 is secured to the frame by bolts 56. The recoil pad 54 is configured to absorb recoil of the firearm when the firearm is fired. The cover 52 assists in preventing damage to the buttstock of the firearm. A similar rear support 16 is disclosed in U.S. Pat. No. 9,702,653, which is hereby incorporated by reference in its entirety. The stop 42 is configured to transmit rearward force of the firearm generated during recoil from the stop to the frame 12. Desirably, rearward acceleration caused by the recoil force is substantially resisted by mass of the shooting rest 10 augmented by removable weight, as explained more fully in U.S. Pat. No. 8,621,773, incorporated by reference above. In the present case, the removable weight comprises liquid or other material in the tank 20 to reduce recoil felt by the shooter. Other types of rigid connections of the stop to the frame and other types of stops for providing a backing to the firearm can be used without departing from the scope of the present invention. Moreover, other types of rear supports can be used without departing from the scope of the present invention.

In one aspect of the present shooting rest 10, the shooting rest is constructed to prevent movement of the tank 20 with respect to the frame 12. It will be appreciated that when the firearm is fired, the resulting recoil force imparted on the stop will tend to move the frame 12 rearward. If the frame 12 is not sufficiently secured to the tank 20, the frame may move rearward with respect to the tank. This would result in ineffective or inefficient recoil reduction and provide a poor user experience. Desirably, the tank 20 is secured to the frame 12 such that the tank is prevented from moving in any direction with respect to the frame (especially forward). The shooting rest 10 is constructed such that the tank 20 and frame 12 move conjointly as a unitary structure. If the interior of the tank 20 is filled with liquid, and the tank is prevented from moving with respect to the frame 12, the recoil reduction will be most effective and the user will have the sensation of the liquid filled tank acting as a stationary weight anchoring the shooting rest. To secure the tank 20 to the frame 12, the frame can sandwich the tank, press against opposite sides of the tank, engage several surfaces of the tank, capture the tank, and/or be nested with the tank, as will become apparent. Desirably, the securement of the tank 20 to the frame 12 is accomplished without passing a fastener (e.g., bolt, screw, rivet, etc.) into the interior of the tank where liquid is stored because an opening in the tank for such a fastener may provide a path for liquid to leak out of the tank.

Figure 8:
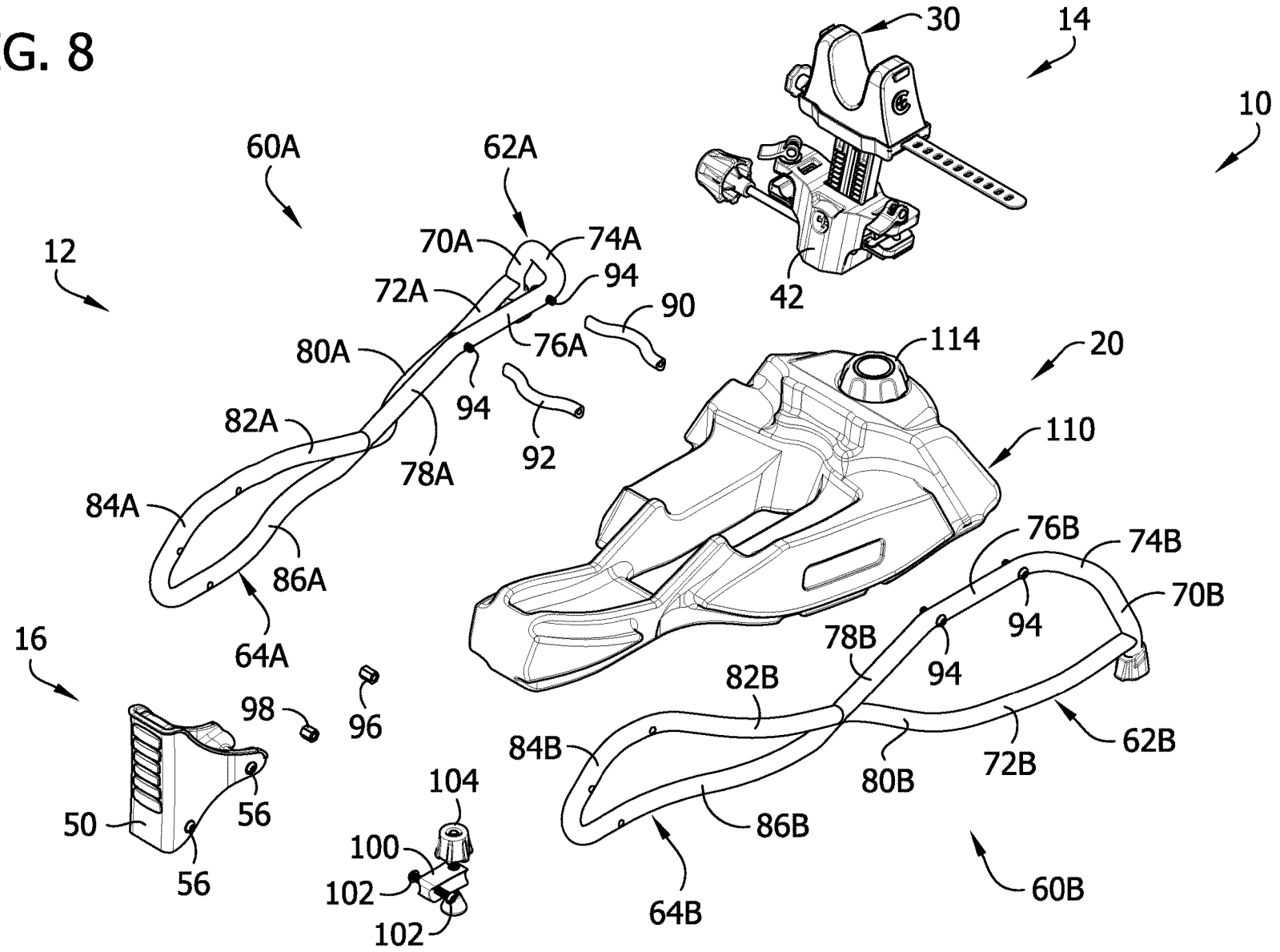
FIG. 8 is an exploded rear perspective of the shooting rest.

Referring now to FIG. 8, the frame 12 includes a left (first) frame member 60A and a right (second) frame member 60B. The frame members 60A, 60B are configured to sandwich the tank 20 from respective left and right sides of the tank. The frame members 60A, 60B can be formed of tubular material (e.g., tubular steel or another suitable metal or plastic) or other components such as bars, angles, and/or plates. In the illustrated embodiment, the frame members 60A, 60B are constructed of lengths of tubular metal bent and welded together. Various other framing components (tubes, rods, bars, angles, plates, etc.) could be used, and the framing components could be secured together in other ways, such as by fasteners including bolts, screws, rivets, etc.

Each frame member 60A, 60B defines a forward harness 62A, 62B (FIG. 8) for cradling a forward portion of the tank 20 and a rearward harness 64A, 64B (FIG. 8) for cradling a rearward portion of the tank. The forward harness 62A, 62B comprises a forward loop of framing, and the rearward harness comprises a rearward loop of framing. The forward and rearward loops of framing are connected at a junction about midway along the length of the frame members 60A, 60B between the forward and rear ends of the shooting rest 10. Other types of framing harnesses (e.g., non-looped) can be used without departing from the scope of the present invention.

The frame members 60A, 60B include a plurality of frame portions (e.g., lengths of the tubular or cylindrical framing material) making up the forward harnesses 62A, 62B and rearward harnesses 64A, 64B. The frame members 60A, 60B include forward generally upstanding frame portions 70A, 70B. Lower frame portions 72A, 72B extend rearward and inward from lower ends of the upstanding frame portions 70A, 70B. Upper frame portions 74A, 74B extend inward and rearward from upper ends of the upstanding frame portions 70A, 70B. Additional upward frame portions 76A, 76B (on which the forward firearm support 14 is slidable) extend rearward from inner ends of the frame portions 74A, 74B. Slanted frame portions 78A, 78B extend rearward and downward to join with lower frame portions 80A, 80B that extend rearward and upward from the lower frame portions 72A, 72B to complete the loops of the forward harnesses 62A, 62B. From the junction, slanted frame portions 82A, 82B extend rearward, upward, and inward to curved frame portions 84A, 84B curving downward and back toward the junction. From the junction, lower frame portions 86A, 86B extend rearward and inward to join lower ends of the curved frame portions to complete the loops of the rearward harnesses 64A, 64B.

The frame 12 includes bridges configured to span gaps between the frame members 60A, 60B to secure the frame members to each other. A first bridge 90 in front of the forward support 14 and a second bridge 92 behind the forward support connect the upper frame portions of the forward harnesses 62A, 62B. The first and second bridges 90, 92 define the forward and rearward extents to which the forward firearm support 14 is slidable on the upper frame portions 76A, 76B. The first and second bridges 90, 92 comprise respective lengths of tubing extending between and fastened by bolts 94 to the frame members 60A 60B. Three additional bridges 96, 98, 100 connect the frame members 60A, 60B at the rear harnesses 64A, 64B. The third and fourth bridges 96, 98 comprise elongate nuts spanning a gap between and secured to the frame members 60A, 60B by the same fasteners 56 that secure the rear firearm support 16 to the frame 12. The fifth bridge 100 comprises a molded piece of plastic fastened by bolts 102 to the respective frame members 60A, 60B. The rear foot 22 extends downward from the fifth bridge 100 and is height adjustable by rotating of a knob 104 above the bridge. Other types of bridges can be used, and bridges can be omitted, without departing from the scope of the present invention. Other types of framing can be used without departing from the present invention. Moreover, it will be appreciated that the framing could sandwich the tank from upper and lower sides rather than left and right sides of the tank.

Referring to FIGS. 10-14, the tank 20 will now be described in further detail. The tank 20 includes a container 110 defining an interior into which liquid (e.g., water) or a flowable material (e.g., sand, lead shot, etc.) is receivable for increasing the mass of the shooting rest 10. The container 110 can be formed of molded plastic or another suitable material. The tank 20 includes a port 112 (FIG. 9) in fluid communication with the interior and through which the liquid or flowable material can be introduced to and removed from the interior. The tank 20 also includes a cover 114 for selectively opening and closing the port 112. In the illustrated embodiment, the cover 114 comprises a cap threadable onto a collar of the port 112 for closing the port. Other covers can be used, such as valves, etc., without departing from the scope of the present invention.

It will be appreciated that the container 110 defines a basin constructed to hold liquid therein. In the illustrated embodiment, the basin comprises the bottom wall portions and the generally upstanding wall portions of the container that form a trough for holding liquid. The basin of the container is covered by the upper wall portions of the container. Desirably, the wall portions forming the basin (and desirably all of the wall portions of the container) are free of openings through which liquid can pass. In the illustrated embodiment, the only opening in the container 110 is provided at the port 112 (FIG. 9). Accordingly, the likelihood of liquid leaking from the container 110 is minimized. However, it will be appreciated that the basin can be liquid tight even if one or more openings are provided in the basin. For example, the openings may be sealed by suitable gaskets, sealant, etc.

Figure 12:
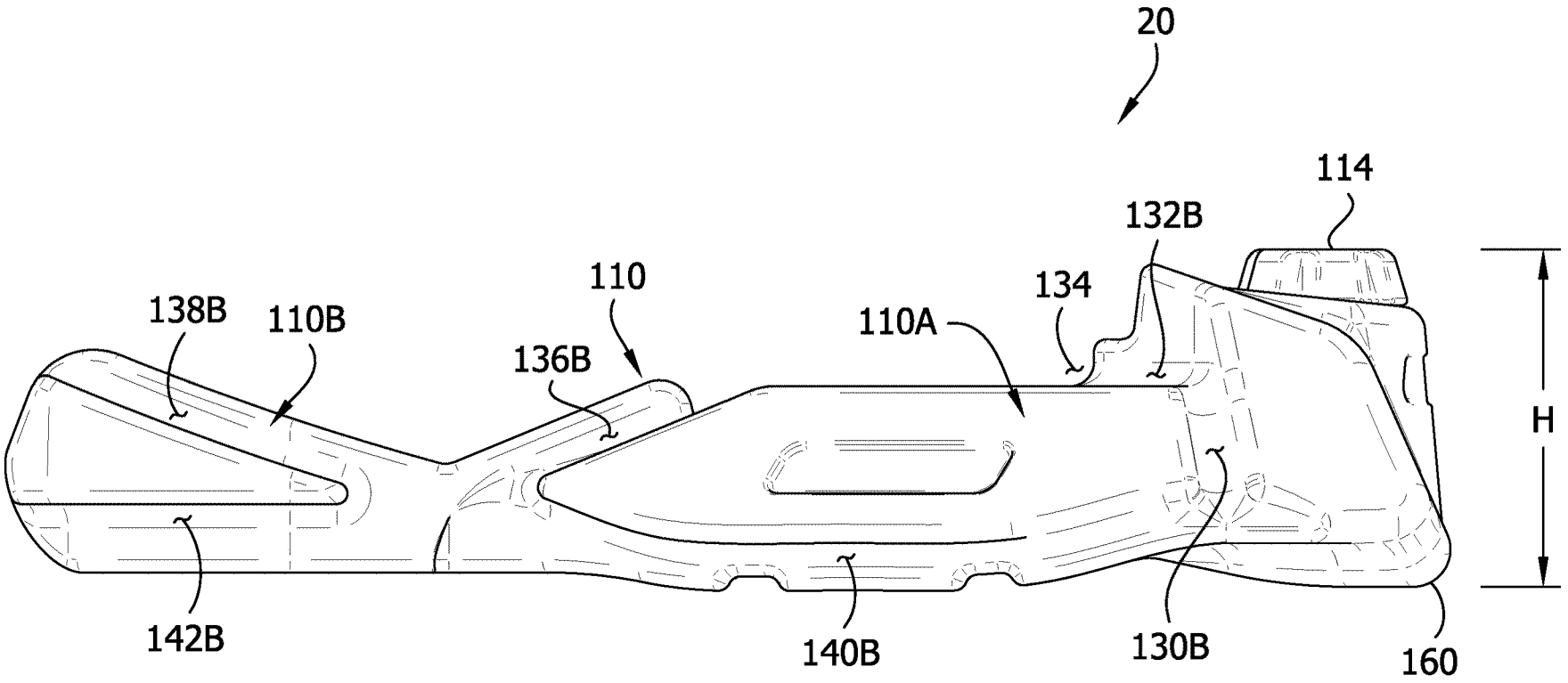
FIG. 12 is a right elevation of the tank.
Figure 13:
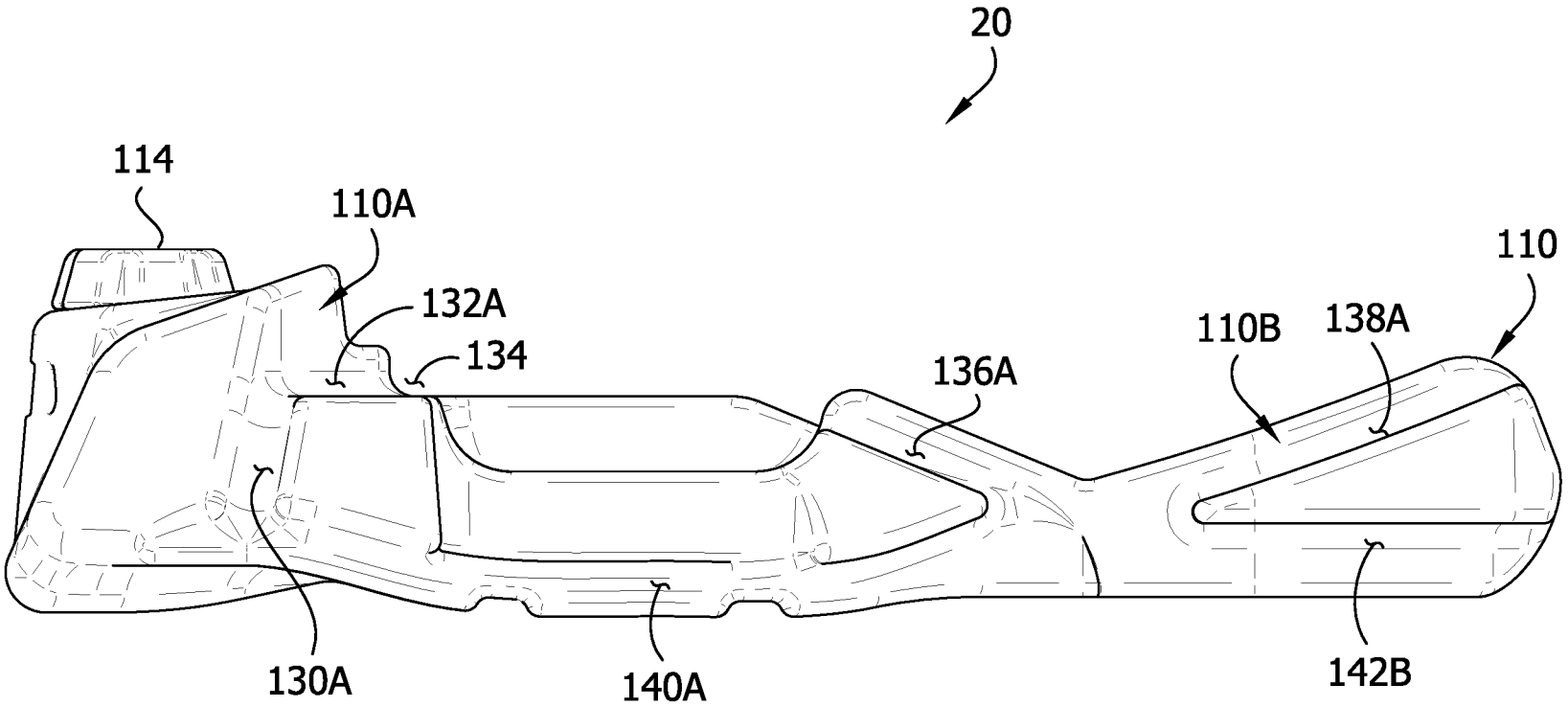
FIG. 13 is a left elevation of the tank.
Figure 14:
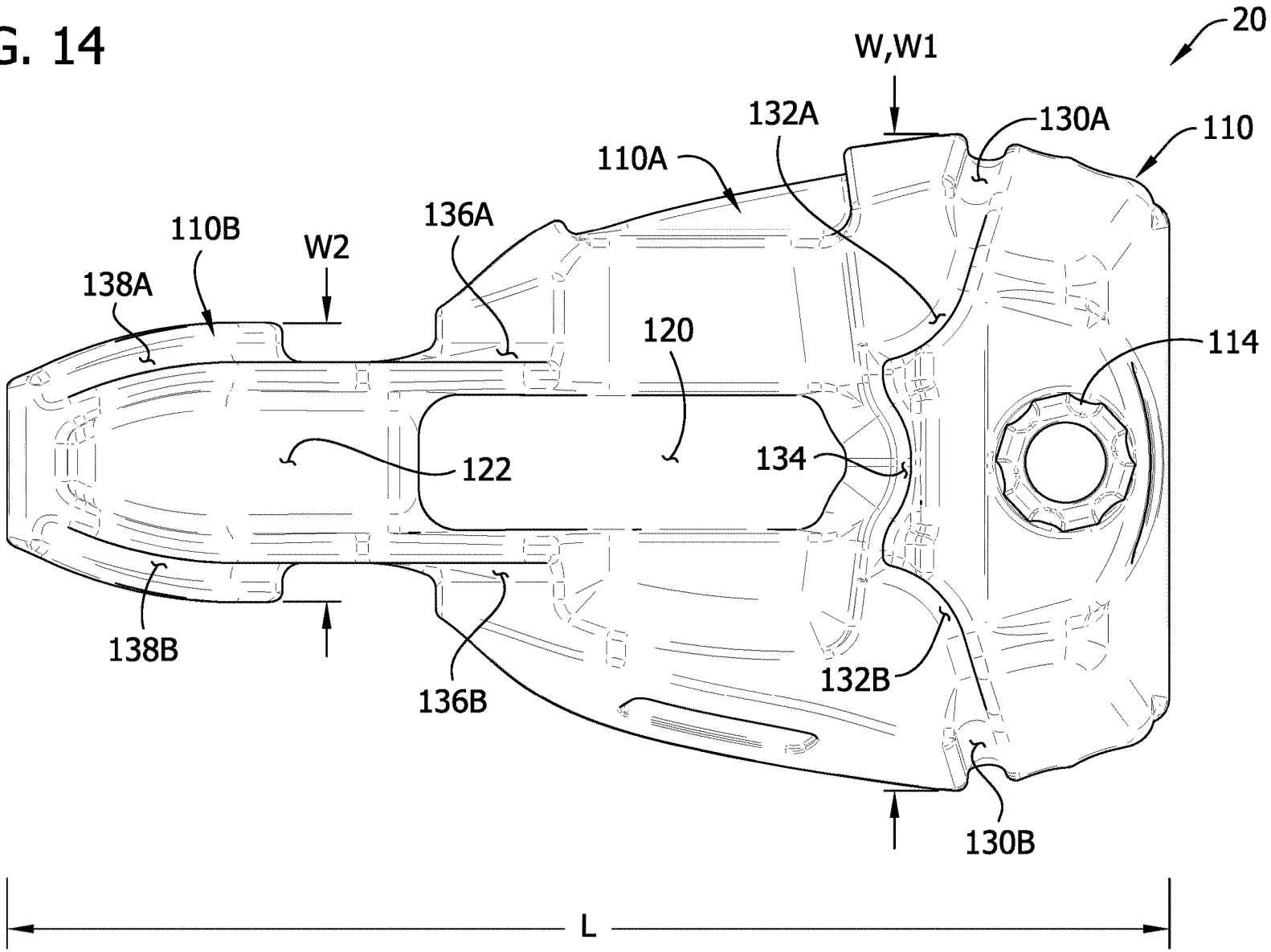
FIG. 14 is a top view of the tank.

As shown in FIG. 14, the container 110 has a length L extending between front and rear ends of the container. As also shown in FIG. 14, the container 110 has a width W extending between left and right sides of the container. Referring to FIG. 12, the container 110 has a height H extending between a top and a bottom of the container. The container 110 is constructed to have a relatively wide head 110A and a relatively narrow tail 110B extending rearward from the head. The head 110A has a width W1 corresponding to the maximum width W of the container overall, and the tail 110B has a substantially lesser width W2. The head 110A of the container is constructed to provide substantial internal volume for holding liquid and extends forward of the front of the frame 12 and in front of the forward firearm support 14.

Figure 10:
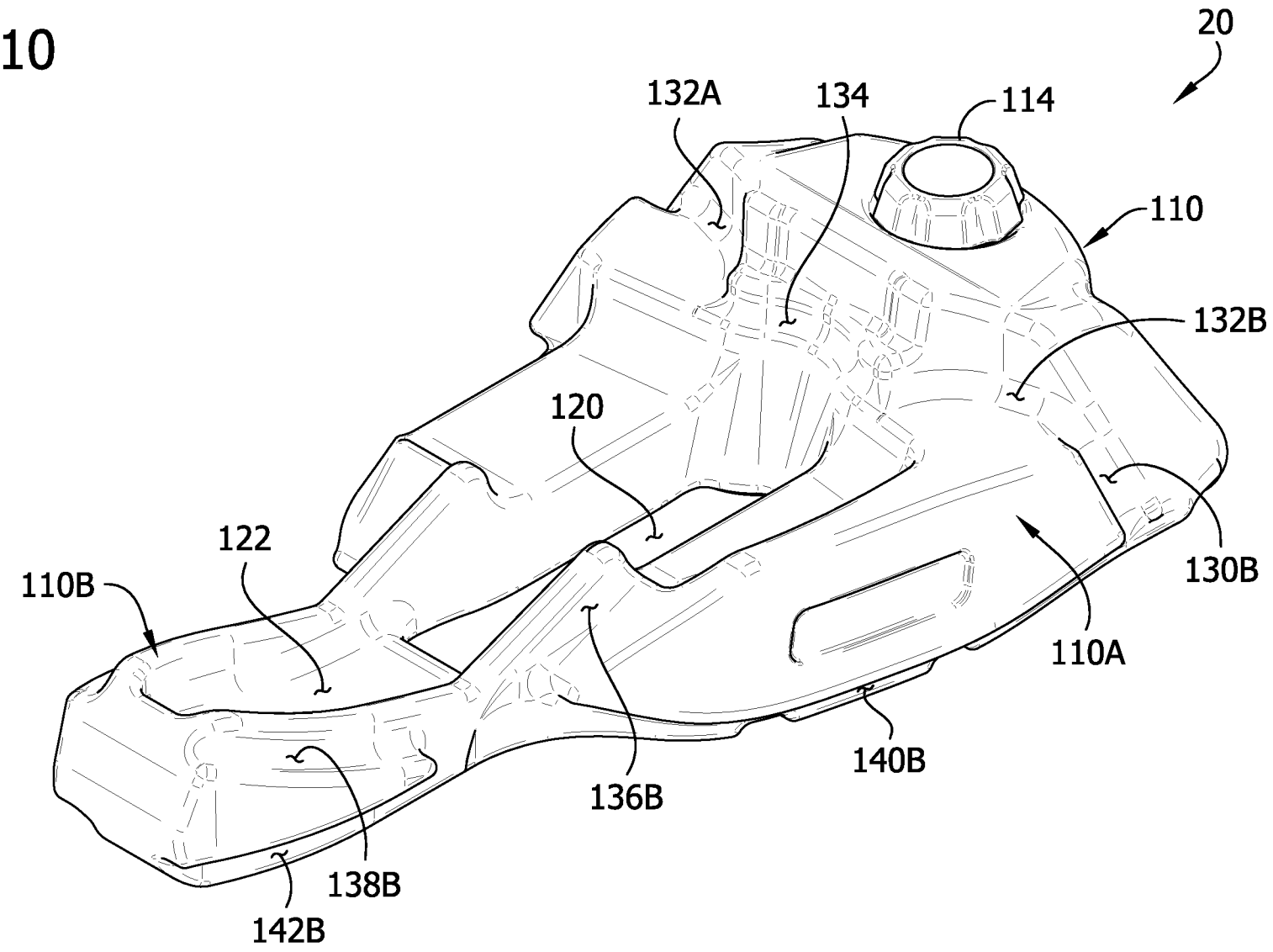
FIG. 10 is a rear perspective of a tank of the shooting rest.
Figure 11:
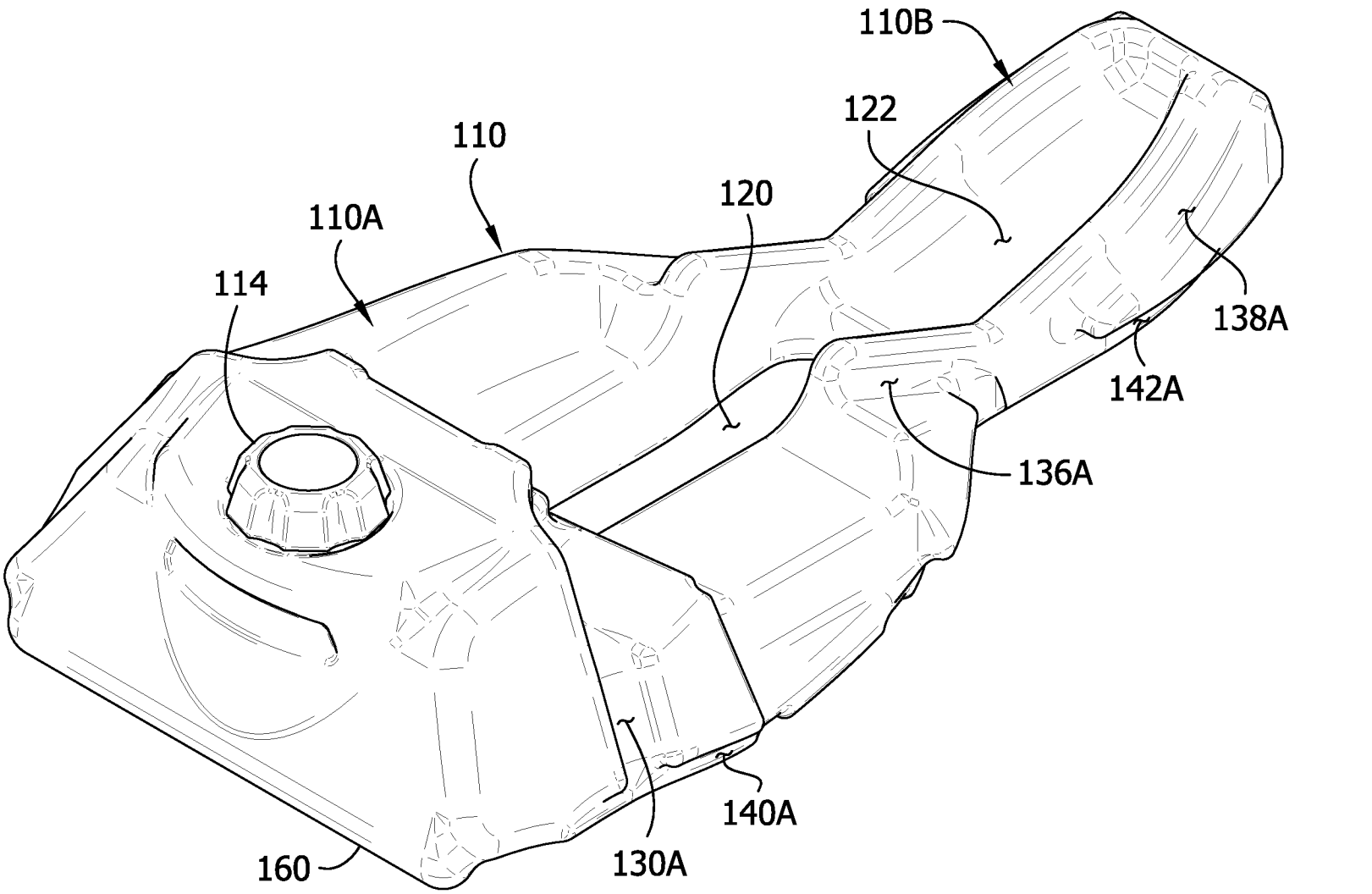
FIG. 11 is a front perspective of the tank.

Referring to FIG. 10, the container 110 includes a first upper recess 120 for reception of the hub 42 and post 34 of the forward firearm support 14. The upper recess 120 is elongate and provides clearance for forward/rearward adjustment of the forward firearm support 14. The recess 120 extends downward and opens out of the bottom of the container 110 and is bounded by generally upstanding sidewalls of the container. The container 110 includes a second upper recess 122 located rearward from the first upper recess 120. The second recess 122 is sized to provide clearance for a magazine extending downward from a firearm supported by the rest. The second recess 122 is bounded by generally upstanding walls of the container 110 and by an upper surface of the container.

The container 110 is configured to nest with the frame 12 to mate the frame with the container for securing the frame to the container. In the illustrated embodiment, several frame-receiving recesses are provided in the container 110 for nesting with various frame portions. The frame receiving recesses open out of the left and right sides of the container 110 for receiving the frame members 60A, 60B as they are moved toward the container to sandwich and capture the container. Referring to FIGS. 10-14, the container includes forward recesses 130A, 130B extending upward for receiving the generally upstanding frame portions 70A, 70B. The left recess 130A is bounded by a curved wall of the container (curving generally about a generally upstanding axis) including outer surfaces facing rearward, leftward, and forward, all of which engage the frame portion 70A. The right recess 130B is bounded by a curved wall of the container including outer surfaces facing rearward, rightward, and forward, all of which engage the frame portion 70B. The container 110 includes upper recesses 132A, 132B extending inward and curving rearward to correspond to and receive the respective frame portions 74A, 74B. The left recess 132A is bounded by a curved wall of the container including outer surfaces facing upward, rearward, and leftward, all of which engage the frame portion 74A. The right recess 132B is bounded by a curved wall of the container including outer surfaces facing upward, rearward, and rightward, all of which engage the frame portion 74B. The container 110 includes a recess 134 extending widthwise of the container to receive the forward bridge 90. The recess 134 is bounded by a curved wall of the container including outer surfaces facing upward, rearward, leftward, and rightward, all of which engage the forward bridge 90. The container 110 includes upper recesses 136A, 136B configured to receive the slanted frame portions 78A, 78B. The recess 136A is bounded by a curved wall of the container 110 including outer surfaces facing upward, rearward, and leftward, all of which engage the slanted frame portion 78A. The recess 136B is bounded by a curved wall of the container including outer surfaces facing upward, rearward, and rightward, all of which engage the slanted frame portion 78B. The container includes rear recesses 138A, 138B configured to receive the frame portions 82A, 82B. The left recess 138A is bounded by a curved wall of the container including outer surfaces facing upward, forward, and leftward, all of which engage the frame portion 82A. The right recess 138B is bounded by a curved wall of the container including outer surfaces facing upward, forward, and rightward, all of which engage the frame portion 82B. The container 110 includes lower recesses 140A, 140B configured to receive the lower frame portions 72A, 72B, 80A, 80B. The left recess 140A is bounded by a curved wall of the container including outer surfaces facing downward, rearward, and leftward, all of which engage the frame portions 72A, 80A. The right recess 140B is bounded by a curved wall of the container including outer surfaces facing downward, rearward, and rightward, all of which engage the frame portions 72B, 80B. Finally, the container 110 includes lower recesses 142A, 142B configured to receive the lower frame portions 86A, 86B. The left recess 142A is bounded by a curved wall of the container including outer surfaces facing downward, rearward, and leftward, all of which engage the left frame portion 86A. The right recess 142B is bounded by a curved wall of the container including outer surfaces facing downward, rearward, and rightward, all of which engage the right frame portion 86B.

It will now be apparent that when the frame 12 is assembled to sandwich and capture the container 110, the various frame portions 70A-86B engage surfaces of the container facing upward, downward, forward, rearward, leftward, and rightward such that the engagement of the frame with the container prevents movement of the container with respect to the frame. The frame 12 being nested with or mated with the container (e.g., reception of the frame portions 70A-86B in the recesses 130A-142B) assists with engaging the frame with surfaces of the container 110 facing in various directions to unify the frame and container. Desirably, the frame members 60A, 60B, when secured together to sandwich the container 110, press on opposing surfaces of the container to securely capture the container between the frame members. For example, the bridges 90, 92, 96, 98, 100 may be slightly undersized widthwise of the container 110 such that the frame members 60A, 60B press against the sides of the container when they are secured to the bridges. In other words, the container 110 can be slightly compressed in the direction the frame members 60A, 60B were assembled to sandwich the container. Such pressing on or compression of the container 110 can assist in unifying the frame 12 and container to prevent movement of the container with respect to the frame.

Moreover, it will be appreciated that the container 110 is constructed to provide a substantial internal volume for holding liquid but to not interfere with the use of the rest 10. For example, the head 110A of the container 110 is relatively wide, and protrudes laterally outboard from the frame 12 and forward from the front end of the frame to maximize storage volume. On the other hand, the tail 110B of the container 110 is relatively narrow and does not protrude substantially outboard from the frame 12 to not interfere with a shooter's arms when they shoulder a firearm on the shooting rest 10.

The container 110 includes a forward roll support 160, and the port 112 is located on the container 110, to facilitate emptying of the container. In the illustrated embodiment, the roll support 160 comprises a curved roll surface on the container extending widthwise of container at the lower, front end of the container. The roll support 160 is located forward of the two front feet 22. It will be appreciated that a user can empty the container 110 by removing the cap 52 and then elevating the rear end of the rest 10 to begin rolling the rest forward on the roll support 160 to pour liquid out of the port 112. The front of the rest 10 will normally be located at a front of a shooting bench in use, so rolling the rest forward will tend to pour the liquid in front of or over the front of the bench top. It will be appreciated that this provides a convenient way to empty the container 110 without requiring the user to pick up and relocate the rest 10 while fully weighted. It will be appreciated that the port 112 and roll surface 160 could be provided on a side of the rest 10 or the rear of the rest without departing from the scope of the present invention. Moreover, the roll surface could be formed by the frame or a separate piece attached to the frame.

In a method of manufacturing the rest 10, the container 110 can be formed by molding plastic into the shape of the container, the frame members 60A, 60B can be fabricated by bending and/or securing together framing components, and the frame members can be assembled to capture the container to prevent the container from moving with respect to the assembled frame. Desirably, the container 110 defines a basin having an interior and configured to hold liquid in the interior to increase the effective mass of the shooting rest to reduce recoil. The forward and rear firearm supports 14, 16 can be secured to the frame 12 before, after, or at the same time as the frame members 60A, 60B are secured to each other.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A recoil-reducing shooting rest for use by a shooter when shooting a firearm, the firearm having a forward portion and a rearward portion, the shooting rest comprising:

a frame;

a forward firearm support connected to the frame and configured to support the forward portion of the firearm;

a rear firearm support connected to the frame and configured to support the rearward portion of the firearm, the rear firearm support including a stop configured to inhibit rearward movement of the firearm with respect to the frame when the firearm is supported by the forward and rear firearm supports and fired;

a liquid tank formed separately from and supported by the frame, the liquid tank including a container having a top, a bottom, a front end, a rear end, and opposite left and right sides, the container having an interior and configured to hold a volume of liquid in the interior to increase an effective mass of the shooting rest to reduce recoil felt by the shooter when the firearm is supported by the shooting rest and fired, the container including a liquid port in fluid communication with the interior of the container, and the liquid tank including a cover configured to selectively open and close the liquid port;

the container has a height extending between the top and bottom of the container, a length extending between the front and rear ends of the container, and a width extending between the left and right sides of the container, and wherein the container includes a head and a tail, the head of the container sized to hold a first volume of liquid, the tail of the container sized to hold a second volume of liquid less than the first volume of liquid, the head of the container having a width extending widthwise of the container, the tail of the container having a width extending widthwise of the container and being less than the width of the head, the head located forward of the rear firearm support, and the tail extending rearward from the head toward the rear firearm support.

2. A recoil-reducing shooting rest as set forth in claim 1, wherein the frame includes a first frame member and a second frame member in engagement with respective opposing first and second surfaces of the container, the first and second frame members being secured to each other to press against said respective opposing first and second surfaces.

3. A recoil-reducing shooting rest as set forth in claim 1, wherein the frame includes a first frame member and a second frame member in engagement with respective opposing first and second surfaces of the container, the first and second frame members being secured to each other to sandwich the container, the container including a first recess bounded by the first surface of the container, the container including a second recess bounded by the second surface of the container, the first frame member including a frame portion received in the first recess, and the second frame member including a frame portion received in the second recess.

4. A recoil-reducing shooting rest as set forth in claim 3, wherein the first recess is located on a first side of the container and the second recess is located on a second side of the container opposite the first side.

5. A recoil-reducing shooting rest as set forth in claim 1, wherein the frame is in nested engagement with the container and the nested engagement of the frame with the container is configured to prevent forward movement of the container with respect to the frame when the firearm is supported by the shooting rest and fired.

6. A recoil-reducing shooting rest as set forth in claim 5, wherein the nested engagement of the frame with the container is configured to prevent rearward, downward, leftward, and rightward movement of the tank with respect to the frame.

7. A recoil-reducing shooting rest as set forth in claim 5, wherein the frame includes a first frame member and a second frame member in engagement with respective opposing first and second surfaces of the container, the first and second frame members secured to each other to press against said respective opposing first and second surfaces.

8. A recoil-reducing shooting rest as set forth in claim 1, wherein the container includes a first recess and the frame includes a first frame portion extending along and received in the first recess to nest the frame and the container.

9. A recoil-reducing shooting rest as set forth in claim 8, wherein the container includes second, third, and fourth recesses and the frame includes second, third, and fourth frame portions extending along and received in the respective second, third, and fourth recesses to nest the frame and the container.

10. A recoil-reducing shooting rest as set forth in claim 1, further comprising a roll support on which the shooting rest is configured to be rolled to pour liquid from the basin out of the liquid port.

11. A recoil-reducing shooting rest as set forth in claim 10, wherein the roll support is defined by the container.

12. A recoil-reducing shooting rest as set forth in claim 10, wherein the container has a width extending between the left and right sides of the container, and the roll support is located at a forward end of the shooting rest forward from the rear firearm support and extends widthwise with respect to the container.

13. A recoil-reducing shooting rest as set forth in claim 1, wherein the basin extends forward of a forward most portion of the frame.

14. A recoil-reducing shooting rest for use by a shooter when shooting a firearm, the firearm having a forward portion and a rearward portion, the shooting rest comprising:

a frame;

a forward firearm support connected to the frame and configured to support the forward portion of the firearm;

a rear firearm support connected to the frame and configured to support the rearward portion of the firearm, the rear firearm support including a stop configured to inhibit rearward movement of the firearm with respect to the frame when the firearm is supported by the forward and rear firearm supports and fired;

a liquid tank formed separately from and supported by the frame, the liquid tank including a container having a top, a bottom, a front end, a rear end, and opposite left and right sides, the container having an interior and configured to hold a volume of liquid in the interior to increase an effective mass of the shooting rest to reduce recoil felt by the shooter when the firearm is supported by the shooting rest and fired, the container including a liquid port in fluid communication with the interior of the container, and the liquid tank including a cover configured to selectively open and close the liquid port;

wherein the container has an upper recess into which the forward firearm support extends.

15. A recoil-reducing shooting rest as set forth in claim 14, wherein the container has an upper recess configured to receive a magazine extending downward from the firearm when the firearm is supported by the forward and rear firearm supports.

* * * * *